US007997968B2

(12) United States Patent
Seelig et al.

(10) Patent No.: US 7,997,968 B2
(45) Date of Patent: Aug. 16, 2011

(54) GAMING DEVICE AND METHOD

(75) Inventors: Jerald C. Seelig, Absecon, NJ (US); Lawrence M. Henshaw, Hammonton, NJ (US)

(73) Assignee: Atlantic City Coin & Slot Service Company, Inc., Pleasantville, NJ (US)

( * ) Notice: Subject to any disclaimer, the term of this patent is extended or adjusted under 35 U.S.C. 154(b) by 966 days.

(21) Appl. No.: 11/855,626

(22) Filed: Sep. 14, 2007

(65) Prior Publication Data

US 2009/0075716 A1 Mar. 19, 2009

(51) Int. Cl.
*A63F 9/24* (2006.01)

(52) U.S. Cl. ..... 463/8; 463/2

(58) Field of Classification Search ..... 463/2, 8
See application file for complete search history.

(56) References Cited

U.S. PATENT DOCUMENTS 4,448,419 A 5/1984 Telnaes
5,456,465 A 10/1995 Durham
5,788,573 A 8/1998 Baerlocher et al.
5,848,932 A * 12/1998 Adams ..... 463/20
6,309,300 B1 10/2001 Glavich
6,439,995 B1 8/2002 Hughs-Baird et al.

* cited by examiner

*Primary Examiner* — Pierre E Elisca
(74) *Attorney, Agent, or Firm* — Ian F. Burns & Associates, P.C.

(57) ABSTRACT

A gaming device includes several changeable prize displays with each changeable prize display sequentially displaying several different prizes. A moveable indicator can move relative to the changeable prize displays and selectively indicate at least one of the prize displays by moving proximate the position of the indicated prize display. The gaming device has a player input device and a controller that are in communication with each other and the changeable prize displays. The controller can cause each of the changeable prize displays to sequentially display the different prizes and to move the moveable indicator relative to the changeable prize displays. The controller can randomly select a prize and detect activation of the player input device. The moveable indicator can stop, after the player input device is activated. A changeable prize display closest to the moveable indicator can display the randomly selected prize.

20 Claims, 17 Drawing Sheets

GAMING DEVICE AND METHOD

BACKGROUND OF THE INVENTION

1. Field of Invention

The present invention relates to gaming devices and, more particularly, to a gaming device and method having a moveable video indicator.

2. Description of the Related Art

Gaming Devices

Gaming devices are well known in the art and a large variety of gaming devices have been developed. In general, gaming devices allow users or players to play a game. In many casino-type gaming devices, the outcome of the game depends, at least in part, on a randomly generated event. For example, a gaming device may use a random number generator to generate a random or pseudo-random number (for convenience, these will both be referred to as "random numbers"). The random number may then be compared to a predefined table to determine the outcome of the event. If the random number falls within a certain range of numbers on the table, the player may win a predefined prize. The table may also contain display information that allows the gaming device to generate a display that corresponds to the outcome of the game. The gaming device may present the outcome of the game on a large variety of display devices, such as mechanical spinning reels or video screens.

Bonus Prizes

Some gaming devices award bonus prizes in addition to prizes that are awarded in the primary game. A bonus prize can be defined as an additional prize that is awarded to the player when a predefined event occurs. An example of a bonus game can be found in U.S. Pat. No. 5,848,932 issued to Adams, which is hereby incorporated by reference. One of the gaming devices described in this document comprises three spinning reels and a spinning wheel bonus display. When predetermined indicia are displayed on the spinning reels of the primary game, the wheel can be activated to indicate a bonus prize. The bonus prize is awarded in addition to any prizes awarded in the primary game.

Generally, bonus prizes are awarded in order to increase the excitement and enjoyment experienced by players, which attracts more players to the game and encourages players to play longer. When this occurs, the gaming devices tend to be more commercially successful relative to other gaming devices. A shortcoming of present bonus games is that they do not sufficiently allow players to participate in the determination of bonus prizes.

Other attempts have been made to provide player interaction. U.S. Pat. No. 5,788,573 to Baerlocher et al. (hereinafter, "Baerlocher") purports to suggest a gaming device with an electronic "wheel of fortune game." Several flippers appear to indicate positions on the wheel. Baerlocher appears to suggest that the player may be allowed to choose which flipper is used to select an indicia on the wheel. However, the player does not appear to have any control over the position of the flipper and the flippers do not appear to be capable of moving to different positions.

U.S. Pat. No. 6,309,300 to Glavich (hereinafter, "Glavich") and U.S. Pat. No. 6,439,995 to Hughs-Baird et al. (hereinafter, "Hughs-Baird") purport to suggest a gaming system having a bonus feature where a player may be allowed to select a number of selectable items, which may be prize representations, on a video display. Glavich and Hughs-Baird do not appear to suggest using prize indicators, moveable prize indicators, or allowing a player to position a prize indicator.

Display Devices

Highly visible display devices are utilized on gaming devices in order to attract players. Once players are attracted to the gaming device, they tend to play longer because the display device enhances the stimulation and excitement experienced by players. It is, therefore, desirable for gaming devices to incorporate highly visible display devices.

Display devices may be more successful if they utilize moveable objects rather than simulations. Although video devices and electronic signs can be used for display devices, players may be more attracted to display devices that utilize moveable objects. Moveable objects may be even more effective display devices if the player is allowed to participate in the operation of the object.

In view of the foregoing, there is a need in the art for a gaming device that provides bonus prizes with a physically movable video display or indicator, and allows for a player to at least partially participate in the selection of a prize.

SUMMARY

1. Advantages of the Invention

The various embodiments of the present invention may, but do not necessarily, achieve one or more of the following advantages.

provides a highly attractive and entertaining device for displaying bonus prizes;

allows players to participate in the selection of a bonus prize;

provides one or more moveable video displays;

provides a moveable video display that can be positioned adjacent to a stationary video display;

allows players to select either a stationary video display or a moveable video display position;

provides several video presentations that can be shown on a moving video display;

provides a server that can store a large number of video presentations that correspond with a game theme;

allows players to participate in the selection of a bonus prize without affecting the game outcome or any prize that may be awarded;

provides the appearance that the player has control of some part of a bonus game;

provides for random prize selection while giving the player the appearance of influencing the prize selection;

provides one or more changeable prize displays;

provides for a display that sequentially flashes prizes;

allows a game player to control movement of an indicator; and allows a game player to select a display.

These and other advantages of the present invention may be realized by reference to the remaining portions of the specification, claims, and abstract.

2. Brief Description of Certain Aspects of the Invention

In one embodiment, the present invention is directed to a gaming device. The gaming device preferably includes at least one game apparatus that may allow a player to place a wager and play a game. The game apparatus is preferably configured to produce a bonus-activating event.

In another embodiment, the present invention provides a gaming device that includes several changeable prize displays with each changeable prize display configured to sequentially display several different prizes. A moveable indicator can move relative to the changeable prize displays and selectively indicate at least one of the prize displays by moving proximate the position of the indicated prize display. The gaming device further has a player input device and a controller that is in communication with the player input device and the changeable prize displays. The controller is configured to cause each of the changeable prize displays to sequentially display the different prizes and to move the moveable indicator relative to the changeable prize displays. The controller further can randomly select a prize and detect activation of the player input device. The moveable indicator can stop, after the player input device is activated. A changeable prize display closest to the moveable indicator can display the randomly selected prize.

In another embodiment, the present invention is directed to a method of operating a gaming device. The method includes sequentially displaying a plurality of different prizes on a plurality of changeable prize displays. A moveable indicator is moved proximate to the changeable prize displays. A player input device is provided to allow a player to stop the moveable indicator using the player input device. A prize is randomly selected and displayed on the prize display closest to the stopped moveable indicator.

BRIEF DESCRIPTION OF THE DRAWINGS

Embodiments of the present invention are shown in the accompanying drawings wherein.

DETAILED DESCRIPTION OF AT LEAST ONE EMBODIMENT OF THE INVENTION

In the following detailed description of at least one embodiment of the invention, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention.

Figure 1:
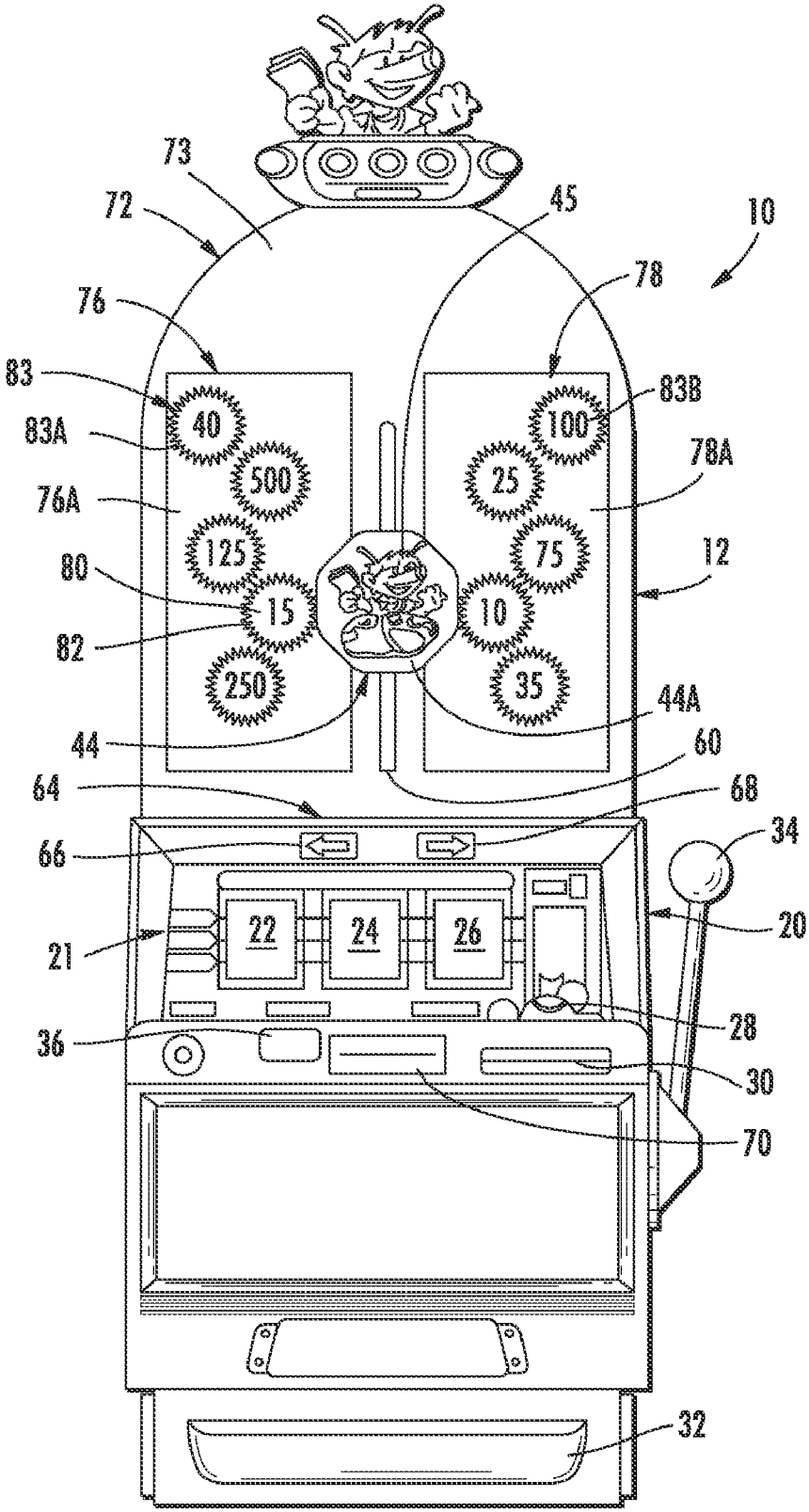
FIG. 1 is substantially a front view of a gaming device of the present invention.

As seen in FIG. 1, the present invention comprises a gaming device, generally indicated by reference number 10. In an embodiment, gaming device 10 comprises a bonus display 12 and a primary game apparatus 20.

Game Apparatus

With continuing reference to FIG. 1, primary game apparatus 20 may be any of a large number of devices that are adapted to allow players to play a game. For example, game apparatus 20 may include a gaming outcome display 21 that utilizes spinning reels 22, 24, and 26 or a video display (not shown) to display outcomes of the game. A value acceptor, such as a coin slot 28 or card reader 30, may also be provided for accepting value from a player. In addition, a payout mechanism, such as a coin dispenser 32, may be provided for awarding prizes. A handle 34 and button 36 are provided for activating game apparatus 20 to begin a game. In at least one embodiment, game apparatus 20 may be an S Plus model gaming device manufactured by International Game Technology in Reno, Nev.

Figure 2:
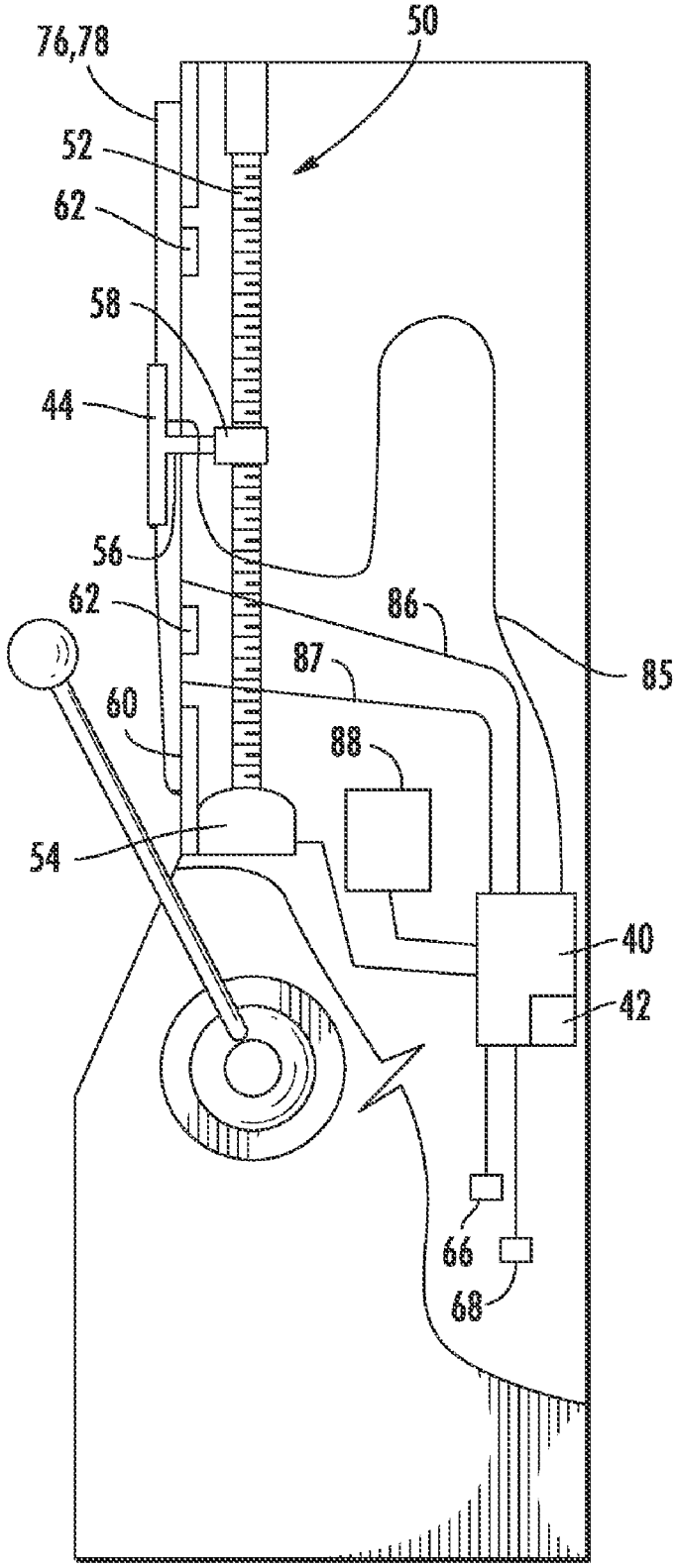
FIG. 2 is substantially a partial cross-sectional view of the gaming device of FIG. 1.

Referring also to FIG. 2, game apparatus 20 is preferably controlled by an electronic controller 40 that utilizes a random number generator 42. Random number generator 42 produces a random or pseudo random number for each game. The outcome of the game may be determined by comparing the random number to a table of outcomes stored in a memory and accessed by controller 40. A number of different tables of outcomes may be used and different tables may be used for different games. The tables can be designed so that different prizes have different probabilities of being awarded. Such design techniques are well known in gaming. Examples of such designs are shown in U.S. Pat. No. 4,448,419, issued to Telnaes, and U.S. Pat. No. 5,456,465, issued to Durham, which are hereby incorporated by reference. Controller 40 causes gaming outcome display 21 (FIG. 1), e.g., spinning reels 22, 24, and 26, to show the outcome of the game that corresponds to the outcome determined by random number generator 42. It is recognized that game apparatus 20 may operate in many other ways and still achieve the objects of the present invention.

Game apparatus 20 may further include a memory device 88 that is in communication with controller 40. Memory device 88 may be any suitable storage device such as a hard disc drive, random access memory (RAM), or CD-ROM device. Memory device 88 may be used to store various game parameters and information such as music, audio sounds and video presentations.

Game apparatus 20 may also be capable, via controller 40 or another bonus control mechanism (not shown), of producing a bonus-activating event. This event may be many different types of events. For example, a bonus-activating event may comprise a game outcome, such as displaying a particular symbol, e.g., a "bonus" symbol, or combination of symbols, such as three "7" symbols on reels 22, 24, and 26. If the game being played is poker based, the bonus-activating event may be an occurrence of a certain hand, such as a royal flush. Furthermore, a bonus-activating event may occur when a player accumulates a number of symbols or game outcomes over a number of separate game plays. For example, a bonus-activating event may occur when the player receives three "bonus" symbols during a period of time. The bonus-activating event may be based on an external event. For example, a bonus-activating event may occur when a group of players obtain a certain result.

Figure 3:
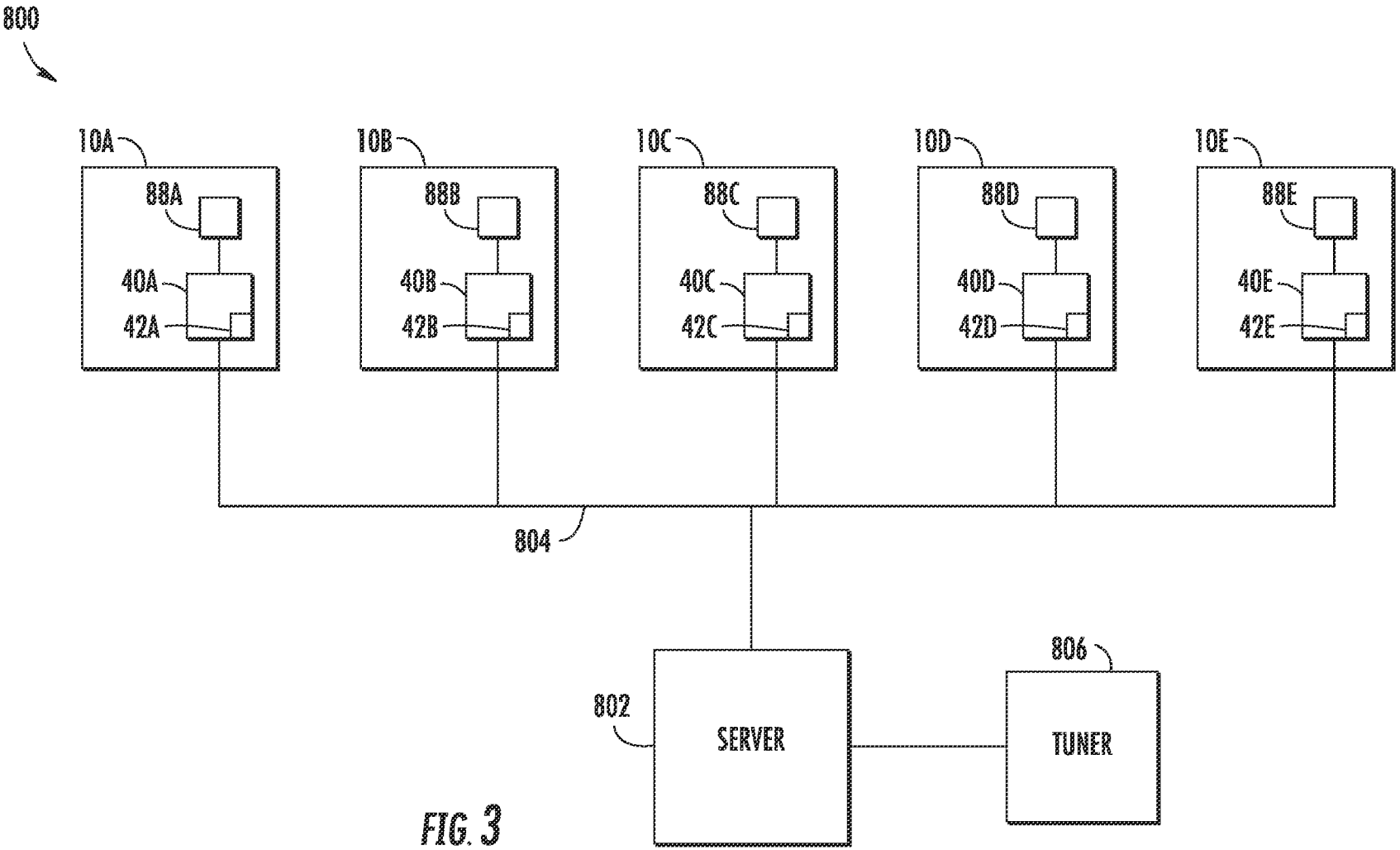
FIG. 3 is substantially a diagrammatic view of a gaming network.

Referring now to FIG. 3, a gaming network 800 of several gaming devices 10 including gaming devices 10A, 10B, 10C, 10D and 10E are shown. Network 800 includes gaming devices 10A-E that are connected to a server 802 by an electrical cable 804. Server 802 can be a conventional computer server and storage devices or a game control computer system. Server 802 can store a wide variety of game information and video presentations. Server 802 may also include a player tracking database that records the actual game play of game players. Electrical cable 804 can be a wide variety of cables such as Ethernet or local area network cables. Alternatively, gaming devices 10 could be connected to server 802 using wireless communications.

Server 802 facilitates communication between gaming devices 10. While five gaming devices 10 were shown in communication with server 802, more or fewer gaming devices 10 could be utilized. Server 802 can further be in communication with a tuner 806. Tuner 806 can receive video presentations from a video source for storage on server 802. Tuner 806 may receive video presentations from a cable network, RF signal or any other suitable network.

Each of gaming devices 10A-E can request game information or a game outcome from server 802. Server 802 can transmit game information including video presentations to one or more of gaming devices 10A-E. Server 802 can control the determination of any game outcome or prize. Controllers 40A-E can receive game information and video presentations from server 802 and store the game information and video presentations on memory devices 88A-88E.

Controller 40 may allow a game player to select a game theme or content to be downloaded from server 802 and shown during the game. For example, controller 40 may present the game player with a selection menu that allows the game player to select a game theme. The game theme could include a wide variety of topics such as sporting events, movies, celebrities, musicians or cartoons. Alternatively, controller 40 and sever 802 could automatically select the theme of the game using previously stored player preference or tracking information.

In another embodiment, server 802 may store game information and controller 40 may be configured to receive the game information from server 802 and select the selected video presentation to be presented based on the game information.

Bonus Display

Referring again to FIG. 1, bonus display 12 can include a housing 72 having a front panel 73. A pair of stationary video displays 76 and 78 can be mounted on front panel 73. Stationary video displays 76 and 78 can be any display that can show video presentations. Stationary video displays 76 and 78 can be liquid crystal (LCD), plasma, electro-luminescent or cathode ray tube (CRT) type video displays. Stationary video display 76 has a front surface 76A and stationary video display 78 has a front surface 78A. In another embodiment, video displays 76 and 78 could be made to move.

Stationary video displays 76 and 78 can show a wide variety of video presentations. The video presentations may be an entertaining video presentation and can be related to a theme of the game. For example, the video presentations may be related to a sporting event, a cartoon, a movie, a television show or a music video. When gaming device 10 is not being played, video displays 76 and 78 may operate in an attract mode and display a video presentation in order to draw attention to gaming device 10.

As part of the video presentation, stationary video displays 76 and 78 can display various indicia 80 in various prize positions 82. Indicia 80 may represent various things, including prize amounts, multipliers, a description or representation of merchandise or services, progressive prizes, or jackpot prizes. The indicia 80 may be moved or scrolled if desired. In FIG. 1, the indicia 80 are shown arranged in bonus prize pairs or sets 83. For example, one of the bonus prize sets 83 can include one indicia shown in position 83A on video display 76 and one indicia shown in position 83B on video display 78.

Bonus display 12 is adapted to select a bonus prize and display the prize to a player. When bonus display 12 is informed that a bonus-activating event has occurred, bonus display 12 causes a moveable video indicator or display 44 to move linearly (in this case vertically) to a selected height.

Moveable video display 44 can be any display that can show video presentations. Moveable video display 44 can be a liquid crystal (LCD), plasma, electro-luminescent or cathode ray tube (CRT) type video display. Moveable video display 44 has a front surface 44A. In another embodiment, video display 44 could be stationary.

Moveable video display 44 can show a wide variety of video presentations. The video presentations may be an entertaining video presentation and can be related to a theme of the game. For example, the video presentations may be related to a sporting event, a cartoon, a movie, a television show or a music video. When gaming device 10 is not being played, moveable video display 44 may operate in an attract mode and display a video presentation in order to draw attention to gaming device 10. Moveable video display 44 may display a space ship 45.

Moveable video display 44 can have a plurality of stop positions (levels) provided, and each stop position can indicate one of the plurality of bonus sets 83. Each bonus set 83 includes at least two bonus prizes, (shown by indicia 80), which are displayed adjacent indicator 44.

In the example shown in FIG. 1, there are five different vertical stop positions, each indicating two bonus prizes, and indicator 44 has stopped at a height adjacent to and indicating a bonus prize set 83 having indicia 80 with a value of "15" and "10".

Moveable video display 44 is illustrated showing a video presentation of a space ship with an alien pilot and prize positions 82 may appear to be planets or stars. However, many other shapes and objects may be shown on video displays 44, 76 and 78.

As shown in FIG. 2, moveable video indicator 44 is made to move up and down by a positioning or drive mechanism 50. The drive mechanism may be a large variety of different devices. For example, as shown in FIG. 2, drive mechanism 50 may be a vertically positioned worm gear 52 that is caused to rotate by a rotary electric motor or actuator 54. Moveable video indicator 44 may be attached to worm gear 52 by a bracket 56 that is attached to a nut 58 threaded on worm gear 52. A slot 60 (best shown in FIG. 1) may be provided in the front panel 73 of bonus display 12, which allows bracket 56 to pass through the face. Sensors 62 may be provided to allow controller 40, or other bonus control mechanisms (not shown), to detect the position of moveable video indicator 44. While moveable video indicator 44 was shown to move vertically, it may also be moved horizontally, or diagonally or in a non-linear fashion such as in rotating manner.

Moveable video display 44 can be electrically connected or in communication with controller 40 through a flexible electrical cable 85. Flexible cable 85 allows moveable video display 44 to freely move while being connected to controller 40. Electrical cable 86 connects stationary video display 76 to controller 40. Electrical cable 87 connects stationary video display 78 to controller 40.

In one embodiment of the present invention, the player is given the opportunity to select one of the stationary video displays 76 or 78 to display a prize or game outcome. In the exemplary display shown in FIG. 1, the user may select either the left stationary video display 76 or the right stationary video display 78.

The player may indicate his or her choice by making a selection via one or more selectors or player input devices, which may take a variety of forms. In one embodiment, shown in FIG. 1, player input device 64 includes buttons 66 and 68 that allow the player to select the corresponding prize display. For example, the player would press the left button 66 to select the left stationary video display 76. Right button 68 would select the right stationary video display 78. Alternatively, a touch screen (not shown) may be provided in place of, or in addition to buttons 66 and 68. The selector may be any other known or later developed mechanism for selecting between two items. In an alternative embodiment, the player may not be allowed to make a selection using selector 64 and controller 40 may automatically make all selections.

Figure 4:
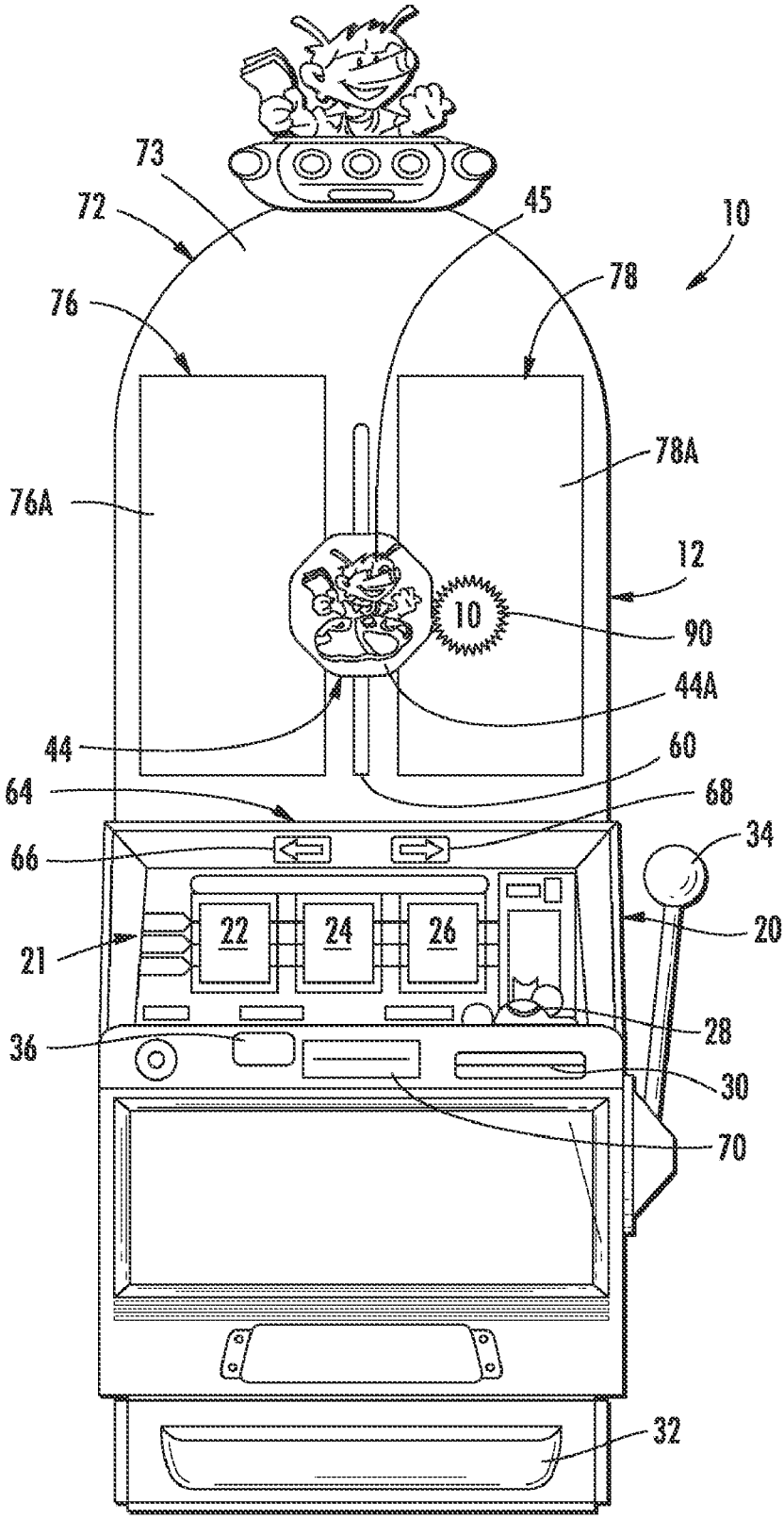
FIG. 4 is substantially a front view of FIG. 1 showing another game display.

Once the player has selected a stationary video display, controller 40 may direct moveable video display 44 to stop adjacent a prize position 82 and present a video presentation on the stationary video display that indicates one or more bonus prizes won by the player. For instance, as shown in FIG. 4, the player has selected stationary video display 78 using button 68. Controller 40 has directed moveable video display 44 to stop and further has recalled a video presentation from memory device 88 to be shown on the stationary video display 78 selected by the player and on moveable video display 44. FIG. 4 shows the combination of moveable video display 44 and stationary video display 78 indicating to a game player a bonus prize or game outcome 90 having a value of "10" credits. At the same time an entertaining video presentation may be shown on stationary video display 78 or moveable video display 44 as part of the indication of a prize or award. Any credits won may be added to the game player's credit meter (not shown).

Therefore, gaming device 10 allows a game player to determine which stationary video display 76 or 78 will display the game outcome, while controller 40 selects the stop position for moveable video display 44 to indicate the game outcome.

In one embodiment, the bonus prizes are randomly generated. The controller generates a random number for each bonus prize to be awarded, and then compares the random number to a pay table similar to that described for game apparatus 20 or as described in U.S. Pat. No. 5,823,874, issued to Adams, which is hereby incorporated by reference. A simple pay table may appear as follows:

| Random Number | Amount Paid |
|---|---|
| 0.00 to 0.50 | $ 1.00 |
| 0.51 to 0.75 | $ 5.00 |
| 0.76 to 0.95 | ×2 |
| 0.96 to 1.00 | $1,000.00 |

For example, if random number generator 42 produced a value of 0.65, $5.00 would be awarded to the player. If the random number generator produced a value of 0.80, the player would receive a multiplier of 2. The multiplier multiplies some amount produced by game apparatus 20. Gaming apparatus 20, for instance, may award $20 and the multiplier would multiply this by two, awarding the player $40.

The bonus selection process may be repeated to accumulate several bonus prize selections that are added to form the award to the game player. The bonus selection process can be repeated a pre-determined number of times. For example, the bonus game could be repeated three times to accumulate an award.

The present invention is not limited to the example pay table shown. Furthermore, different kinds of bonus prizes, besides monetary prizes, may be awarded. For example, the bonus prizes may be goods, services, or additional games. The bonus prize could be a jackpot prize, a progressive prize, or a prize determined by a plurality of networked gaming devices.

Once controller 40 (FIG. 2) or server 802 (FIG. 3) determines the bonus prizes to be awarded, controller 40 causes the appropriate stationary video display to display the prizes after the player has selected one of the displays using selector buttons 66 or 68.

Other effects may also be presented, such as pre-recorded sound from speakers. If the actual bonus prize is money, the amount of the bonus prize may be added to the player's credit meter (not shown) or the bonus prize may be dispensed from dispenser 70 or coin dispenser 32.

Game Method

Figure 5:
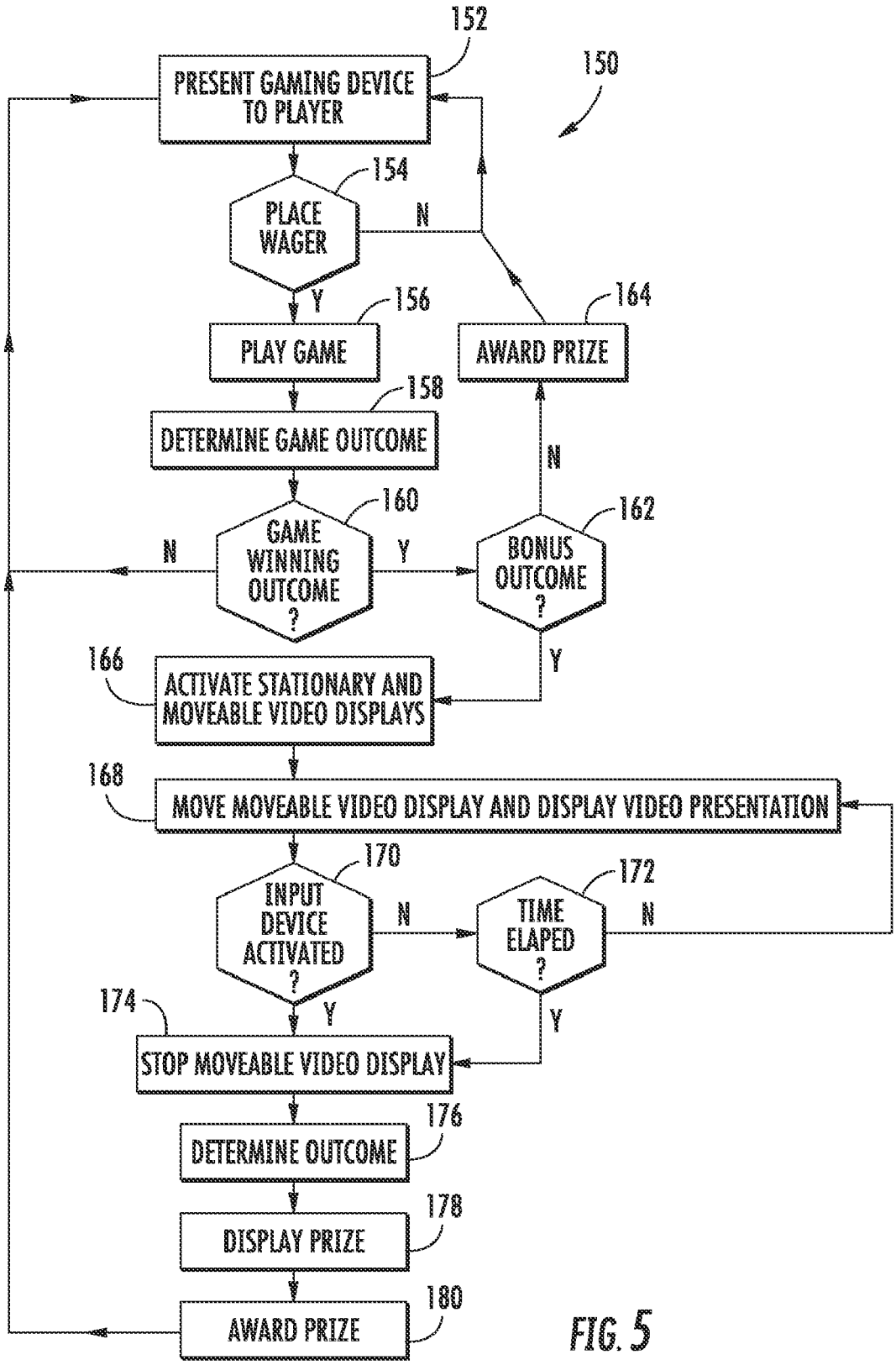
FIG. 5 is substantially a flow chart of a method of operation of the gaming device of FIG. 1.

Turning now to FIG. 5, a flowchart illustrating one possible method of operation of the gaming device 10 depicted in FIGS. 1 and 4 is shown. The method, generally referred to as 150, begins by presenting a gaming device to a player at step 152. Decision 154 then determines if the player has placed a wager. If no wager has been placed, method 150 returns to step 152 until a wager is placed.

If a wager has been placed at decision 154, the player may activate the gaming device and play a game at step 156. The game outcome is determined at step 158. Decision 160 checks to see if the game outcome is a winning outcome.

If decision 160 determines that step 158 resulted in a losing outcome, method 150 returns to step 152. If decision 160 determines that step 158 resulted in a game winning outcome, method 150 proceeds to decision 162. Decision 162 determines whether the game outcome is a bonus activating outcome. If the game outcome from step 158 is not a bonus activating outcome, method 150 awards any prizes to which the player is entitled at step 164 and then returns to step 152.

If decision 162 determines that game outcome 158 is a bonus activating outcome, method 150 activates the bonus display at step 166, preferably enabling player input device 66, stationary video displays 76 and 78 and begins to move moveable video display 44 at step 168. Video displays 76 and 78 may start to display a video presentation. Moveable video display 44 may move in a variety of ways. For example, moveable video display 44 may move all the way up slot 60 (FIG. 1) and then all the way down, then back up, and so on. Alternatively, moveable video display 44 may move randomly or at more than one speed. A video presentation may also be started on moveable video display 44.

Next, method 150 proceeds to decision 170, which ascertains whether the player has activated player input device 66 to select either display 76 or display 78. If the player has not activated player input device 66, method 150 may proceed to step 172. At step 172, method 150 checks to see if any preset time period has elapsed. For example, the game developer may limit the time period to thirty seconds. Once the time period elapses, moveable video display 44 will automatically stop. If this time period has not elapsed, method 150 returns to step 168 and continues movement of moveable video display 44.

If the player has activated a player input device 64 at decision 170, or the time limit has expired in decision 172, method 150 proceeds to step 174. At step 174, the moveable video display 44 is stopped. The bonus game outcome is determined at step 176 and any prize the player has won is displayed by a video presentation on the selected stationary video display 76 or 78 adjacent to the stopped moveable video display 44 at step 178. The player is then awarded the prize at step 180 and then method 150 returns to step 152.

Many other methods may be used to operate the present invention. For example, the order of the steps in FIG. 5 may be altered or interchanged. For example, the input device could be activated prior to activating the video displays. In another example, a player may be allowed to select the theme of a video presentation shown on video displays 44, 76 or 78.

First Alternative Embodiment

Figure 6:
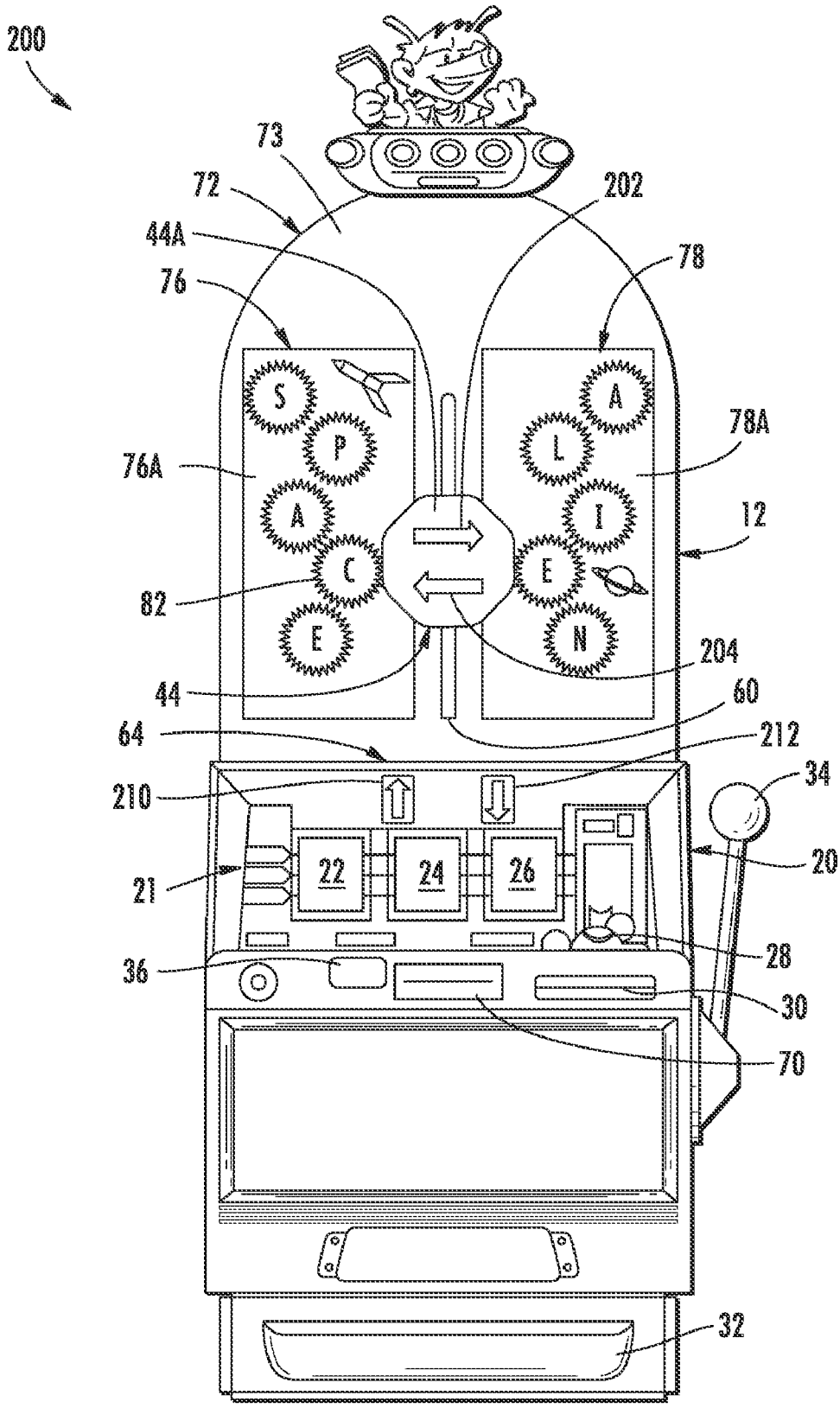
FIG. 6 is substantially a front view of an alternate embodiment of a gaming device of the present invention.

With reference now to FIG. 6, an alternate embodiment of the present invention is shown. Gaming device 200 shown in FIG. 6 is similar to gaming device 10 previously described in FIG. 1. Gaming device 200 includes a pair of player input devices or selector buttons 210 and 212. Buttons 210 and 212 allow a game player to move and stop the movement of moveable video indicator or display 44. Buttons 210 and 212 are in communication with controller 40 (FIG. 2). When button 210 is depressed a first time, moveable video display 44 may move upward. A second depression of button 210 may stop moveable video display 44. When button 212 is depressed a first time, moveable video display 44 may move downward. A second depression of button 212 may stop moveable video display 44.

Moveable video display 44 may show a video presentation that can include a pair of arrows. Right arrow 202 points towards stationary video display 78 and left arrow 204 points toward stationary video display 76.

Stationary video displays 76 and 78 may show a video presentation as directed by controller 40 at the same time that moveable video display 44 moves up and down. Stationary video displays 76 and 78 may include prize symbols or positions 82.

Figure 7:
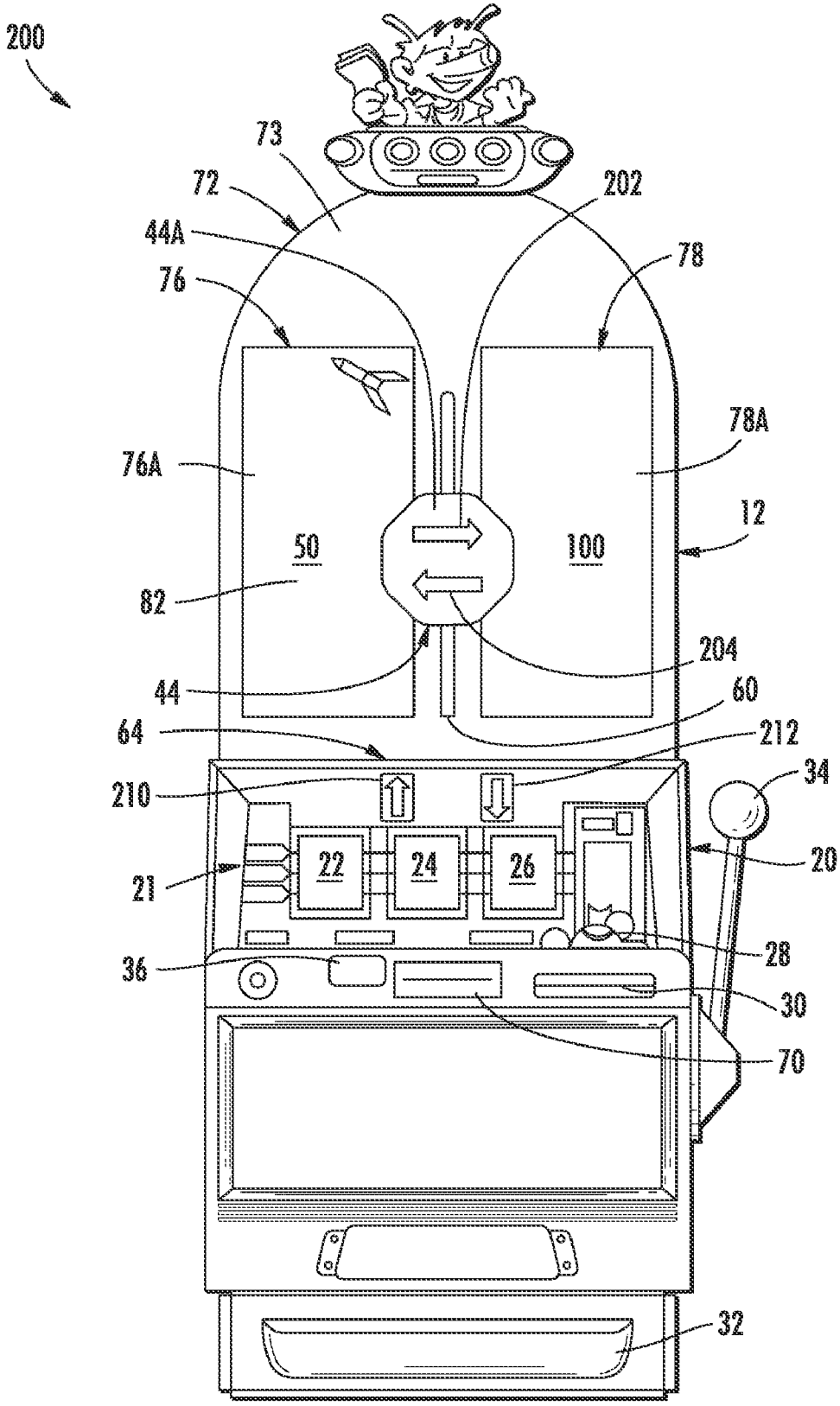
FIG. 7 is substantially a front view of FIG. 6 showing a game display.

Turning now to FIG. 7, gaming device 200 is shown after the game player has stopped movable video display 44 at a certain vertical height. Stationary video display 76 is shown displaying a video presentation with a possible award of 50 credits. Stationary video display 78 is shown displaying a video presentation with a possible award of 100 credits.

Figure 8:
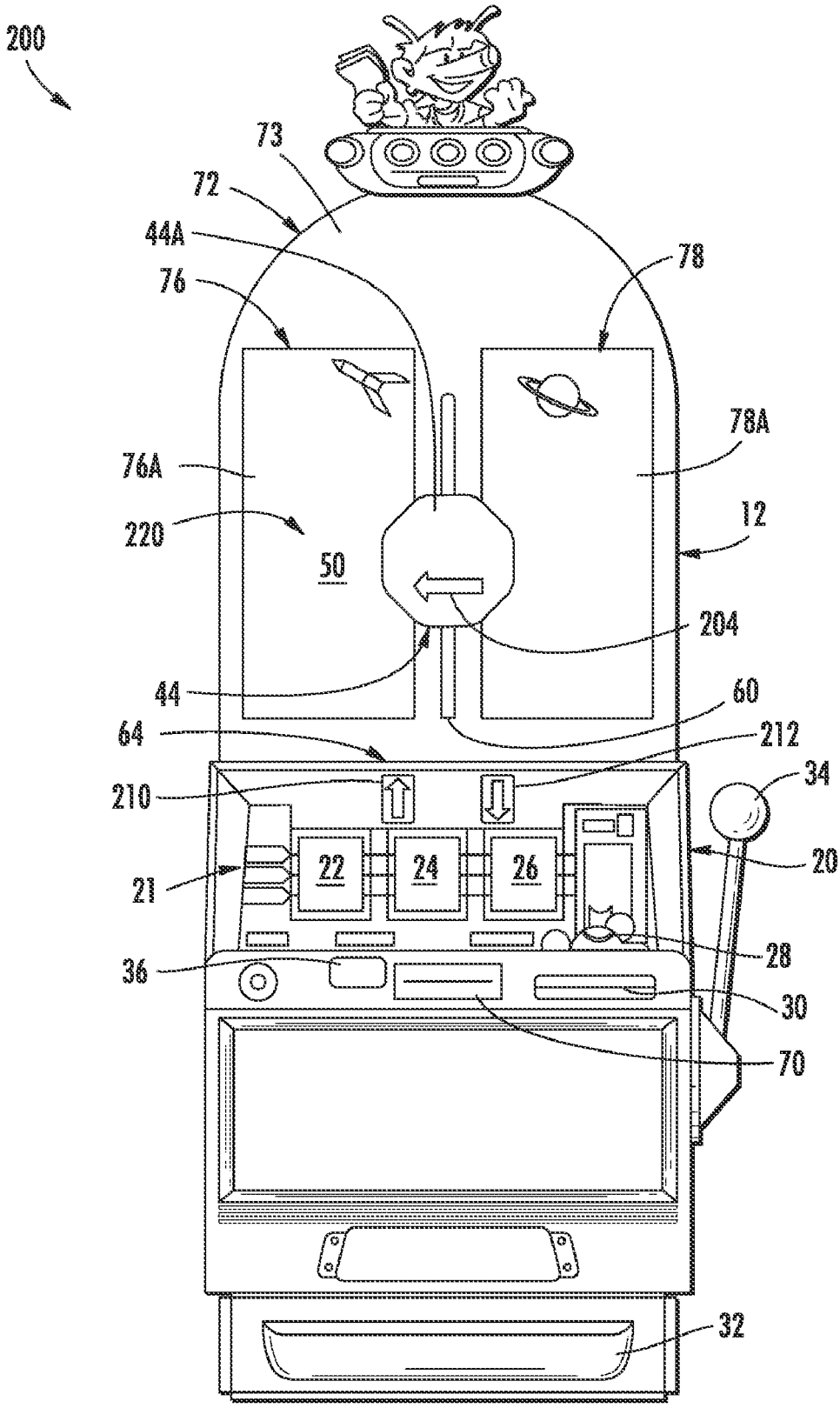
FIG. 8 is substantially a front view of FIG. 6 showing another game display.

FIG. 8 shows the game outcome or final prize awarded by gaming device 200. In FIG. 8, controller 40 has directed video presentations to be shown on stationary video display 76 and moveable video display 44 that show left arrow 204 pointing to a game outcome 220 of 50 credits won.

Therefore, gaming device 200 allows a game player to determine the stop position of moveable video display 44, while controller 40 selects which stationary video display 76 or 78 will display the game outcome.

Game Method of the First Alternative Embodiment

Figure 9:
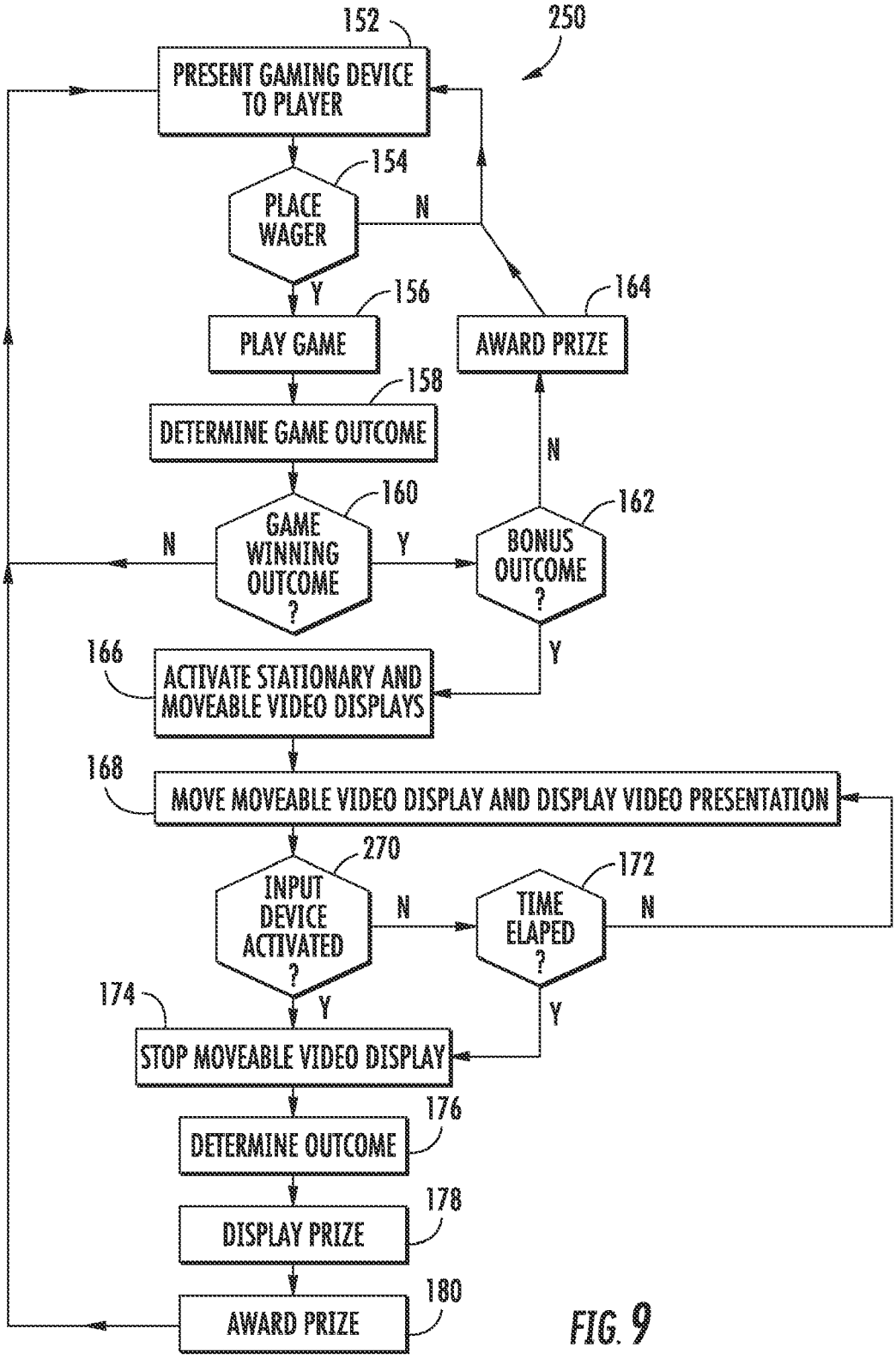
FIG. 9 is substantially a flow chart of a method of operation of the gaming device of FIG. 6.

Referring to FIG. 9, a flowchart illustrating one possible method of operation of the gaming device 200 depicted in FIGS. 6-8 is shown. The method, generally referred to as 250, begins by presenting a gaming device to a player at step 152. Decision 154 then determines if the player has placed a wager. If no wager has been placed, method 250 returns to step 152 until a wager is placed.

If a wager has been placed at decision 154, the player may activate the gaming device and play a game at step 156. The game outcome is determined at step 158. Decision 160 checks to see if the game outcome is a winning outcome.

If decision 160 determines that step 158 resulted in a losing outcome, method 250 returns to step 152. If decision 160 determines that step 158 resulted in a game winning outcome, method 250 proceeds to decision 162. Decision 162 determines whether the game outcome is a bonus activating outcome. If the game outcome from step 158 is not a bonus activating outcome, method 250 awards any prizes to which the player is entitled at step 164 and then returns to step 152.

If decision 162 determines that game outcome 158 is a bonus activating outcome, method 250 activates the bonus display at step 166, preferably enabling player input devices 210, 212, stationary video displays 76 and 78 and begins to move moveable video display 44 at step 168. Video displays 76 and 78 may start to display a video presentation. Moveable video display 44 may move in a variety of ways. For example, moveable video display 44 may move all the way up slot 60 (FIG. 1) and then all the way down, then back up, and so on. Alternatively, moveable video display 44 may move randomly or at more than one speed. A video presentation may be started to display on moveable video display 44.

Next, method 250 proceeds to decision 270, which ascertains whether the player has activated player input devices 210 or 212 in order to select a stop position for moveable video display 44. If the player has not activated the player input device, method 250 may proceed to step 172. At step 172, method 250 checks to see if any preset time period has elapsed. For example, the game developer may limit the time period to thirty seconds. Once the time period elapses, moveable video display 44 will automatically stop. If this time period has not elapsed, method 250 returns to step 168 and continues movement of moveable video display 44.

If the player has activated one of player input devices 210 or 212 at decision 170, or the time limit has expired in decision 172, method 250 proceeds to step 174. At step 174, the moveable video display 44 is stopped. The bonus game outcome is determined at step 176 and any prize the player has won is displayed by a video presentation on stationary video displays 76 or 78 and the moveable video display 44 at step 178. The player is then awarded the prize at step 180 and then method 250 returns to step 152.

Many other methods may be used to operate the present invention. For example, the order of the steps in FIG. 9 may be altered or interchanged. For example, the input device could be activated prior to activating the video displays. In another example, a player may be allowed to select the theme of a video presentation shown on video displays 44, 76 or 78.

Second Alternative Embodiment

Figure 10:
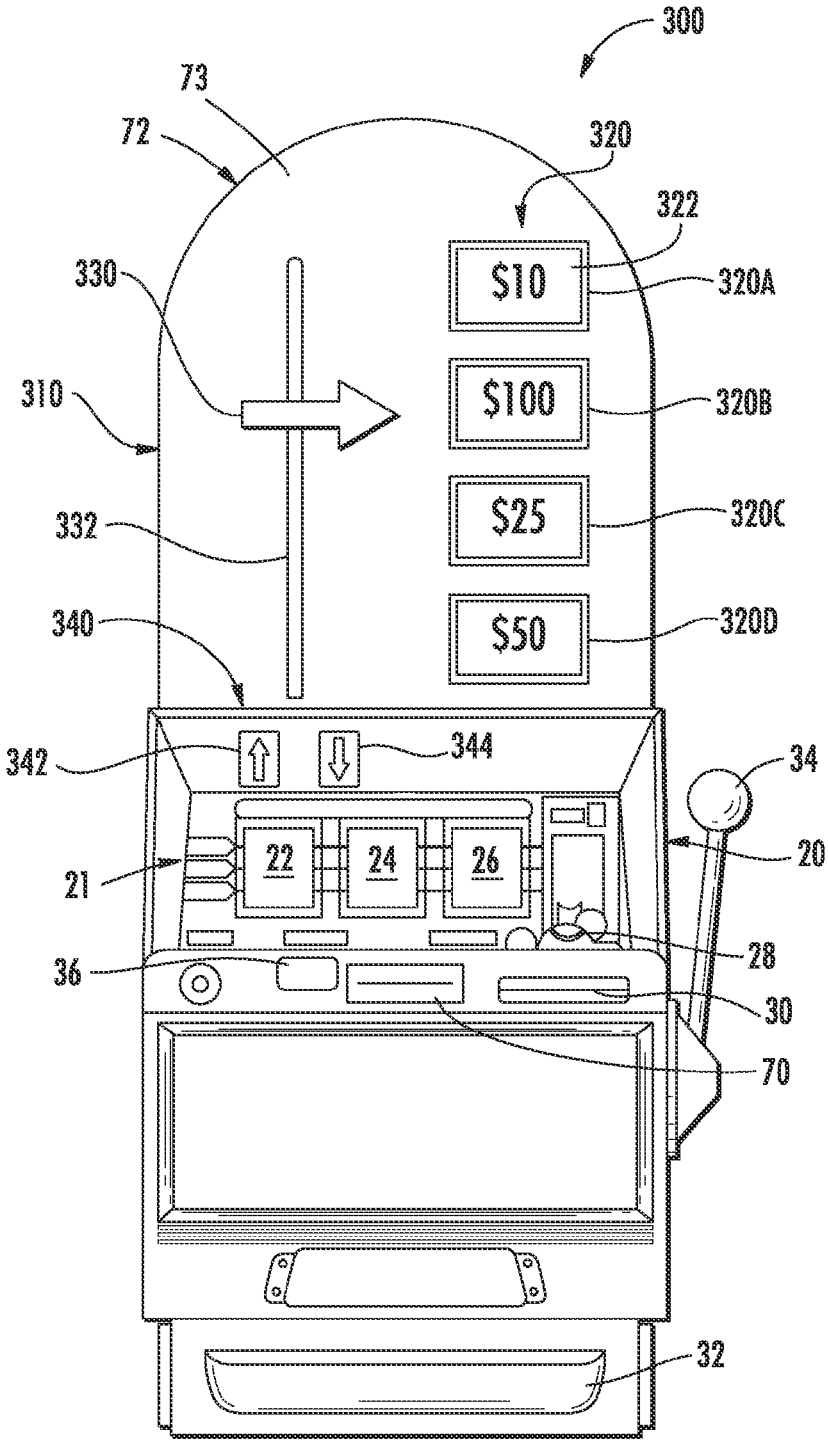
FIG. 10 is substantially a front view of another embodiment of a gaming device of the present invention.

With reference now to FIG. 10, an additional embodiment of the present invention is shown. Gaming device 300 has some similar common features to gaming device 10 previously described in FIG. 1. Gaming device 300 includes a primary game apparatus 20 that is identical to game apparatus 20 described in FIG. 1. Gaming device 300 can also have a bonus game display 310. Gaming device 300 can detect the occurrence of a bonus activating event in gaming apparatus 20 and enter a bonus game sequence.

Bonus game display 310 can include a housing 72 having a front panel 73. A moveable mechanical indicator 330 and a plurality of changeable prize displays 320 can be mounted on front panel 73. Changeable prize displays 320 can be any type of display that can show indicia such as numbers or letters. Changeable prize displays 320 may also be able to show video presentations. Changeable prize displays 320 can be a meter, light emitting diode (LED), liquid crystal (LCD), plasma, electro-luminescent or cathode ray tube (CRT) type video displays.

Four changeable prize displays are shown in FIG. 10 including changeable prize displays 320A, 320B, 320C and 320D. More or less than four changeable prize displays may also be used. In another embodiment, changeable prize displays 320 could be made to move or be moveable.

Changeable prize displays 320A-D can each display a wide variety of indicia 322. Indicia 322 may represent various things, including prize amounts, multipliers, a description or representation of merchandise or services, progressive prizes, or jackpot prizes. The indicia 322 may be flashed or illuminated in rapid order or rapidly scrolled if desired. Along with indicia 322, changeable prize displays 320A-D could also present an entertaining video presentation. The video presentation may be related to a theme of the game. For example, the video presentation may be related to a sporting event, a cartoon, a movie, a television show or a music video. When gaming device 300 is not being played, changeable prize displays 320A-D may operate in an attract mode and display a video presentation in order to draw attention to gaming device 300.

Moveable mechanical indicator 330 can move vertically along slot 332 of front panel 73. Bonus display 300 is adapted to select a bonus prize and display the prize to a player. When bonus display 300 is informed that a bonus-activating event has occurred, bonus display 300 causes moveable mechanical indicator 330 to move linearly (in this case vertically) to a selected height.

Moveable mechanical indicator 330 can have a plurality of stop positions (levels) provided, and each stop position can indicate one of the changeable prize displays 320A-D adjacent indicator 330.

In the example shown in FIG. 10, there are four different vertical stop positions, each indicating a different changeable prize display 320. Moveable mechanical indicator 330 is currently shown at a height adjacent to and indicating changeable prize display 320B having an indicia 322 with a value of $100 dollars or credits.

Figure 11:
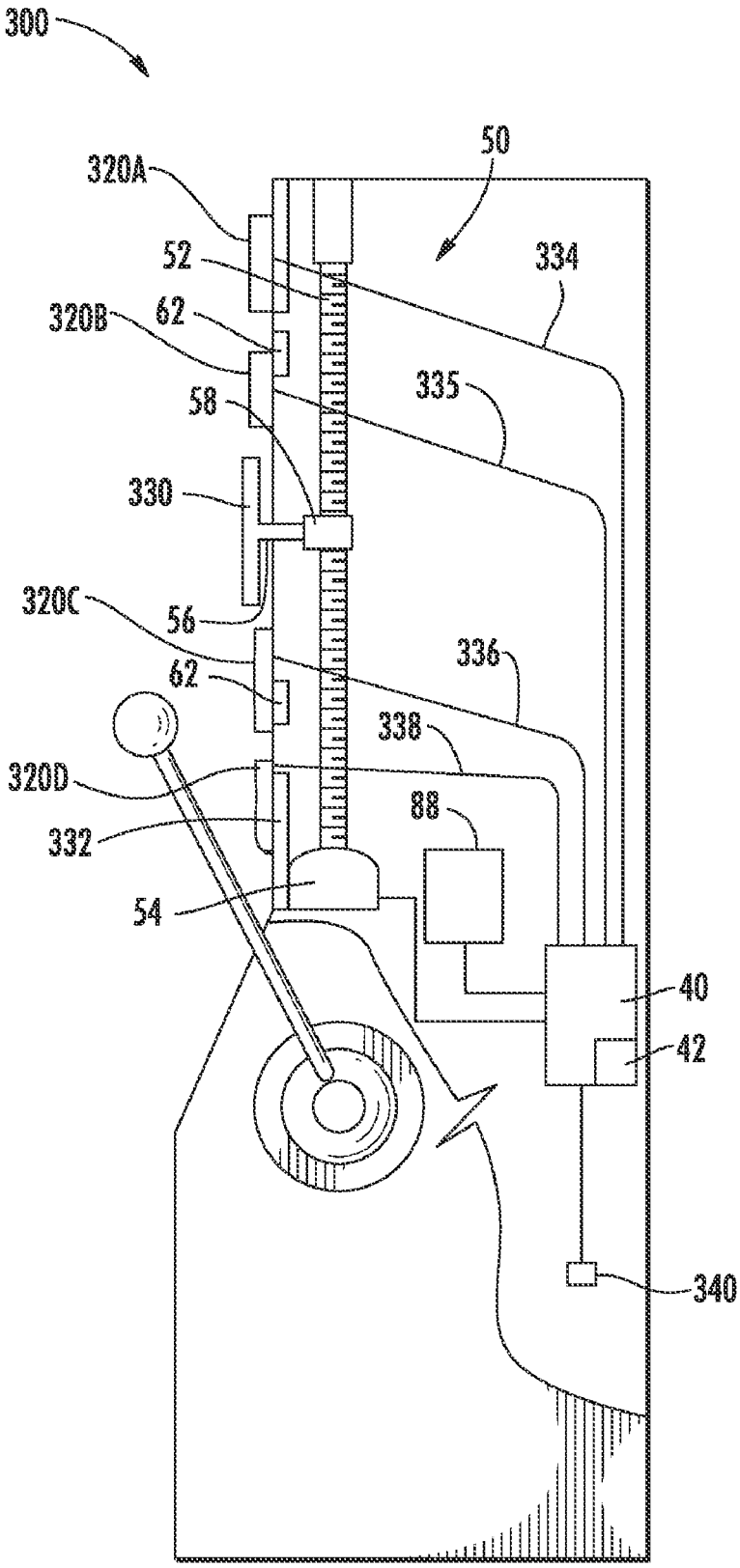
FIG. 11 is substantially a partial cross-sectional view of the gaming device of FIG. 10.

With further reference to FIG. 11, moveable mechanical indicator 330 is made to move up and down by a positioning or drive mechanism 50. The drive mechanism may be a large variety of different devices. For example, as shown in FIG. 11, drive mechanism 50 may be a vertically positioned worm gear 52 that is caused to rotate by a rotary electric motor or actuator 54. Moveable mechanical indicator 330 may be attached to worm gear 52 by a bracket 56 that is attached to a nut 58 threaded on worm gear 52. A slot 332 (best shown in FIG. 10) may be provided in the front panel 73 of bonus display 310, which allows bracket 56 to pass through the face. Sensors 62 may be provided to allow controller 40, or other bonus control mechanisms (not shown), to detect the position of moveable mechanical indicator 330. While moveable mechanical indicator 330 was shown to move vertically, it may also be moved horizontally, or diagonally or in a non-linear fashion such as in rotating manner.

Changeable prize displays 320A-D can be electrically connected or in communication with controller 40 through electrical cables. Electrical cable 334 connects changeable prize display 320A to controller 40. Electrical cable 335 connects changeable prize display 320B to controller 40. Electrical cable 336 connects changeable prize display 320C to controller 40. Electrical cable 338 connects changeable prize display 320D to controller 40.

In one embodiment of the present invention, the player is given the opportunity to select the stop position or location of the moveable mechanical indicator 330. The player may indicate his or her choice by making a selection via one or more selectors or player input devices 340, which may take a variety of forms. In one embodiment, player input devices 340 includes an up button 342 and a down button 344 that allow the player to select the stop position of the moveable mechanical indicator 330.

For example, the player would press the up button 342 to move indicator 330 upwards. Down button 344 would move indicator 330 downwards. When the button is released, moveable indicator 330 may stop. Alternatively another button may be provided to stop the indicator. A joystick could also be used in place of buttons 342 and 344. If the player fails to make a selection after a period of time, controller 40 may automatically select a stop position for indicator 330.

In an alternative embodiment, the player may not be allowed to stop indicator 330 using player input devices 340 and controller 40 may automatically select the stop position.

At the same time, that the game player is selecting a stop position for moveable mechanical indicator 330, controller 40 is randomly changing or flashing indicia 322 in sequence or sequential order on changeable prize displays 320A-D. Thus, various indicia 322 are randomly displayed on one display 320A, then on another display 320B, then another display 320C and then on display 320D. The indicia thus appear to jump from one particular changeable prize display to another changeable prize display.

As an example, the first time that changeable prize display 320A is displayed, an indicia having a value of 10 credits may be shown. The next time changeable prize display 320A may show an indicia having a value of 25 credits. The next time changeable prize display 320A may show an indicia having a value of 50 credits.

When all of changeable prize displays 320A-D are showing indicia 322, the player may then try to stop moveable mechanical indicator proximate or next to the prize display showing a prize amount. In FIG. 10, this corresponds to display 320B showing a prize amount of 100 dollars. The game player may believe that they are selecting the prize amounts.

After the player has selected a stop position for moveable mechanical indicator 330, controller 40 may randomly determine a game outcome. The game outcome prize or indicia is then displayed on the changeable display 320 closest to the stop position of the moveable mechanical indicator. The randomly display of indicia 322 on the other changeable prize displays are then discontinued.

Figure 12:
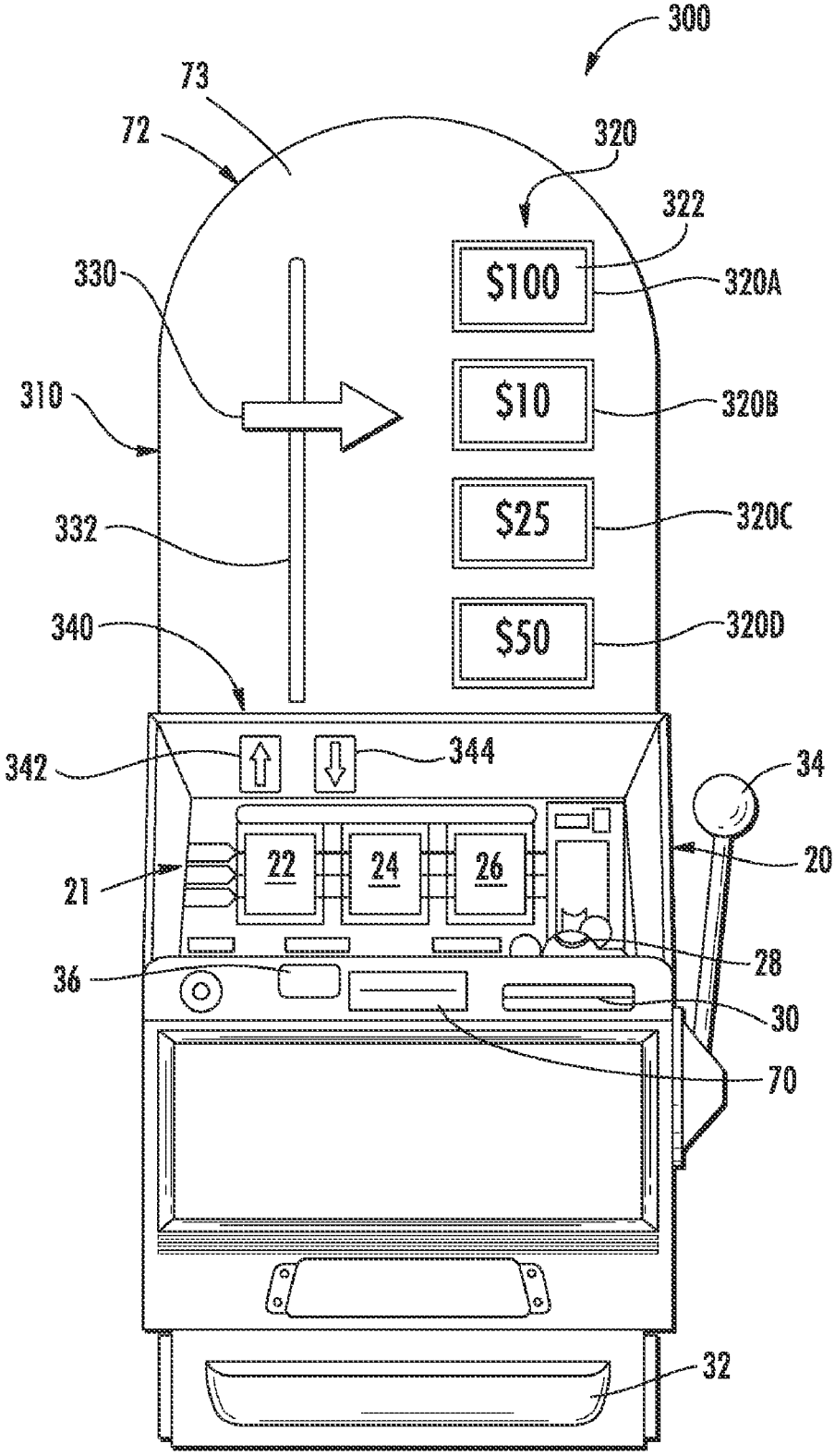
FIG. 12 is substantially a front view of FIG. 10 showing a game display.

An example of the operation of game display 300 is shown in FIGS. 10 and 12. In FIG. 10, the indicia 322 are rapidly being changed on game displays 320. The game player has selected a stop position for moveable mechanical indicator 330 adjacent to display 320B. Controller 40 then determines a game outcome and displays the game outcome to the player. FIG. 12 shows the game outcome or prize of 10 dollars or credits displayed on changeable prize display 320B. It is noted that because the indicia 322 on the changeable prize displays 320 are being rapidly changed, it appears to the player that they may have just missed stopping the indicator on a larger indicia amount.

The player can then see that the combination of the stopped moveable mechanical indicator and one changeable prize display indicates the prize or type of award to be awarded to the player.

Gaming device 300 may give the player the impression that by pressing buttons 342 or 344 at a certain time in order to stop moveable mechanical indicator 330, that the player is determining the indicia to be awarded as a prize. However, in reality, the player is only selecting one of the changeable prize displays 320 on which the prize or game outcome is shown. A random number generator 42 (FIG. 11) and a virtual pay table cooperate with controller 44, in a fashion well known to those skilled in the art, in order to determine which indicia 322 is shown as a final prize or game outcome. The pay table may be similar to the pay table previously described for bonus display 12 of FIG. 1.

In another embodiment, moveable mechanical indicator 330 could be moved and stopped adjacent to several changeable prize displays 320 and the value of all of the indicated indicia added together to form a prize amount.

Changeable prize displays 320 may also show an entertaining video presentation along with indicia 322. A video presentation may also be shown as part of the indication of a prize or award.

In yet another embodiment, indicia 322 may be a multiplier symbol. In this embodiment, the player can be awarded the product of the multiplier symbol and the sum of any prize amounts won on primary gaming device 20.

Several gaming devices 300 also may be connected in a network that is in communication with a server 802 as previously described in FIG. 3. Game information including video presentations may be downloaded from server 800 to gaming devices 300.

Gaming device 300 can create additional player excitement and anticipation by providing the illusion to the game player that they can select a game outcome or prize amount by their actions of stopping moveable mechanical indicator 330.

Game Method of the Second Alternative Embodiment

Figure 13:
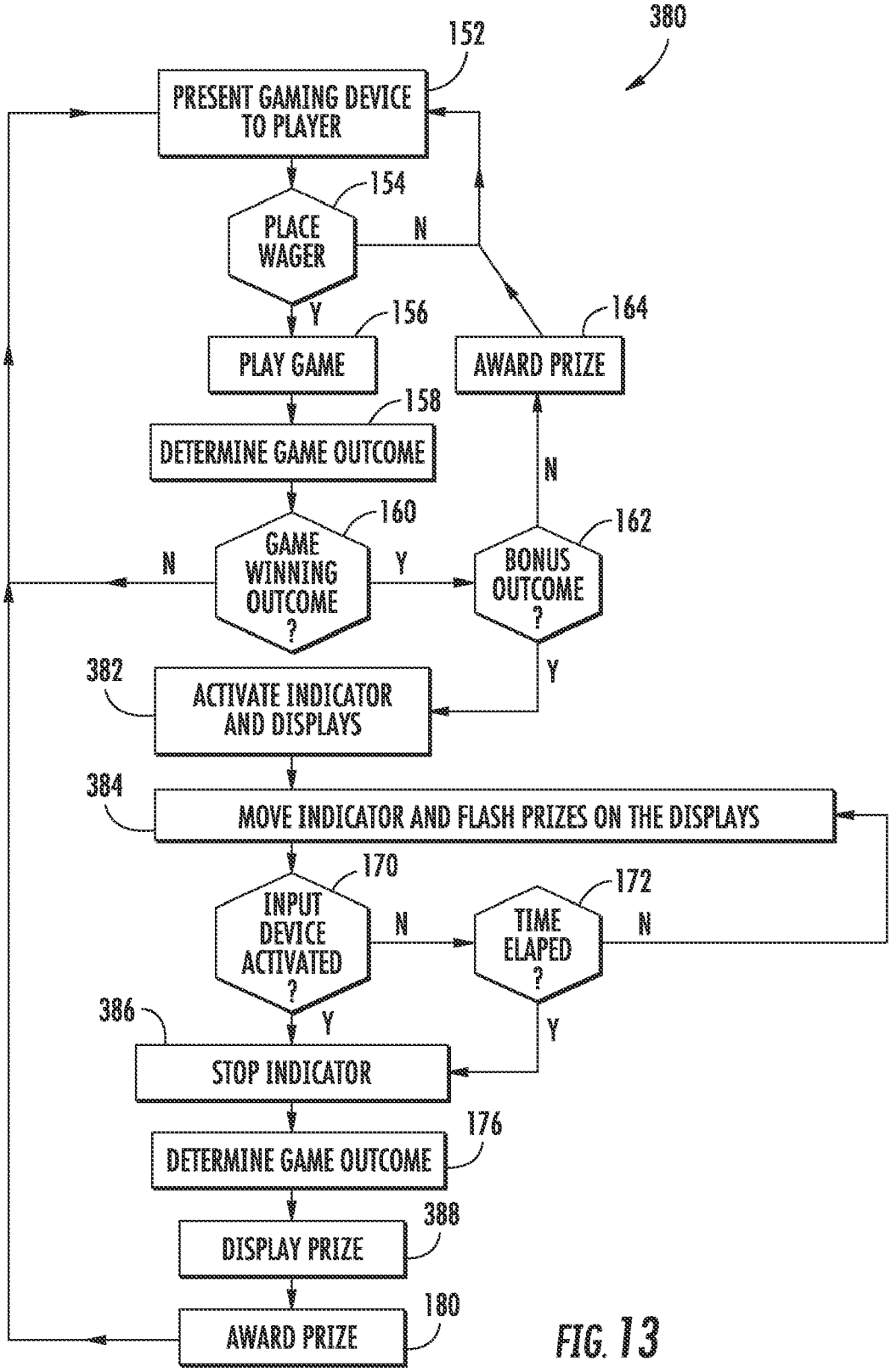
FIG. 13 is substantially a flow chart of a method of operation of the gaming device of FIG. 10.

Turning now to FIG. 13, a flowchart illustrating one possible method of operation of the gaming device 300 depicted in FIGS. 10 and 12 is shown. The method, generally referred to as 380, begins by presenting a gaming device to a player at step 152. Decision 154 then determines if the player has placed a wager. If no wager has been placed, method 380 returns to step 152 until a wager is placed.

If a wager has been placed at decision 154, the player may activate the gaming device and play a game at step 156. The game outcome is determined at step 158. Decision 160 checks to see if the game outcome is a winning outcome.

If decision 160 determines that step 158 resulted in a losing outcome, method 380 returns to step 152. If decision 160 determines that step 158 resulted in a game winning outcome, method 380 proceeds to decision 162. Decision 162 determines whether the game outcome is a bonus activating outcome. If the game outcome from step 158 is not a bonus activating outcome, method 380 awards any prizes to which the player is entitled at step 164 and then returns to step 152.

If decision 162 determines that game outcome 158 is a bonus activating outcome, method 380 activates the bonus display at step 382, preferably enabling player input devices 342, 344, changeable prize displays 320A-D and moveable mechanical indicator 330. At step 384, mechanical indicator 330 is moved and prize indicia 322 are sequentially displayed in a rapid manner on changeable prize displays 320A-D. Moveable mechanical indicator 330 may move in a variety of ways. For example, moveable mechanical indicator 330 may move all the way up slot 332 (FIG. 10) and then all the way down, then back up, and so on. Alternatively, moveable mechanical indicator 330 may move randomly or at more than one speed. A video presentation may also be shown on changeable prize displays 320A-D.

Next, method 380 proceeds to decision 170, which ascertains whether the player has activated player input devices 342 or 344 to stop moveable mechanical indicator 330. If the player has not activated one of player input devices 342 or 344, method 380 may proceed to step 172. At step 172, method 380 checks to see if any preset time period has elapsed. For example, the game developer may limit the time period to thirty seconds. Once the time period elapses, moveable mechanical indicator 330 will automatically stop. If this time period has not elapsed, method 380 returns to step 168 and continues movement of moveable mechanical indicator 330.

If the player has activated one of player input device 342 or 344 at decision 170, or the time limit has expired in decision 172, method 380 proceeds to step 386. At step 386, the moveable mechanical indicator 330 is stopped. The bonus game outcome is determined at step 176 and any prize the player has won is displayed as indicia on the changeable prize display 320 that is adjacent or closest to the stopped moveable mechanical indicator 330 at step 388. The player is then awarded any prizes at step 180 and then method 380 returns to step 152.

Many other methods may be used to operate the present invention. For example, the order of the steps in FIG. 13 may be altered or interchanged.

Third Alternative Embodiment

Figure 14:
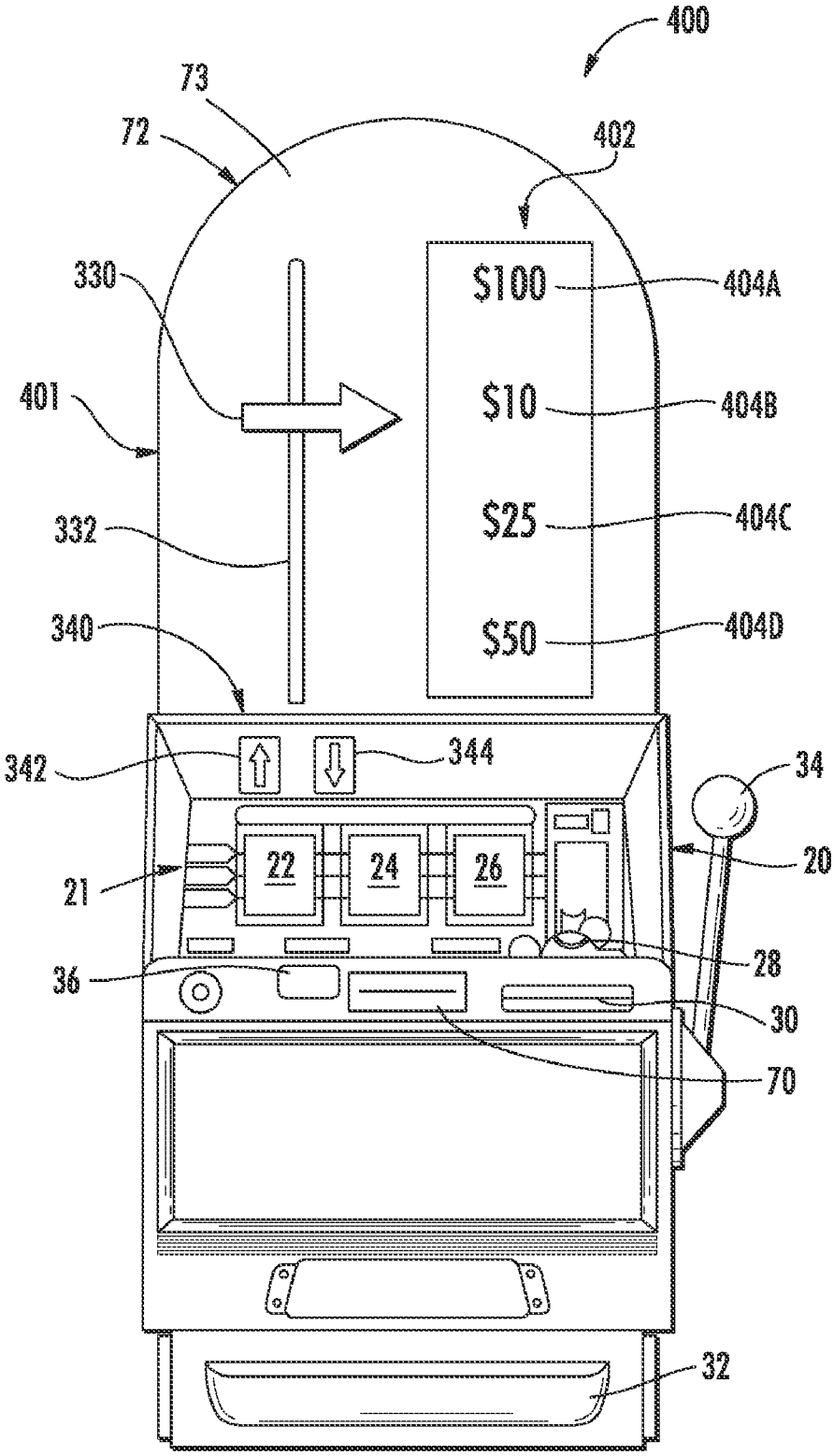
FIG. 14 is substantially a front view of an additional embodiment of a gaming device of the present invention.

With reference now to FIG. 14, an additional embodiment of the present invention is shown. Gaming device 400 has some similar and common features to gaming device 300 previously described in FIG. 10. Gaming device 400 includes a primary game apparatus 20 that is identical to game apparatus 20 described in FIGS. 1 and 10. Gaming device 400 can also have a bonus game display 401. Bonus game display is similar to bonus game display 310 of FIG. 10, except that changeable prize displays 320A-320D have been replaced by a single video display 402. Video display 402 can be any type of video display that can show video presentations. Video display 402 can be liquid crystal (LCD), plasma, electroluminescent or cathode ray tube (CRT) video display. Video display 402 can be in communication with controller 40.

Video display 402 can display a plurality of prize indicia including indicia 404A, 404B, 404C and 404D. Gaming device 400 can detect the occurrence of a bonus activating event in gaming apparatus 20 and enter a bonus game sequence. The indicia 404A-D may be flashed or illuminated in rapid order. Along with indicia 404A-D, video display 402 can also present an entertaining video presentation.

Gaming device 400 can operate similar to gaming device 300. The player may try to stop moveable mechanical indicator 330 proximate or next to the prize indicia 404A-D showing a desired prize amount. After the player has selected a stop position for moveable mechanical indicator 330, controller 40 may randomly determine a game outcome. The game outcome prize or indicia is then displayed on video display 402 closest to the stop position of the moveable mechanical indicator 330. Gaming device 400 can operate in the same manner as shown in method 380 of FIG. 13, except that the possible prizes or indicia are flashed on video display 402 instead of changeable prize displays 320A-D.

Fourth Alternative Embodiment

Figure 15:
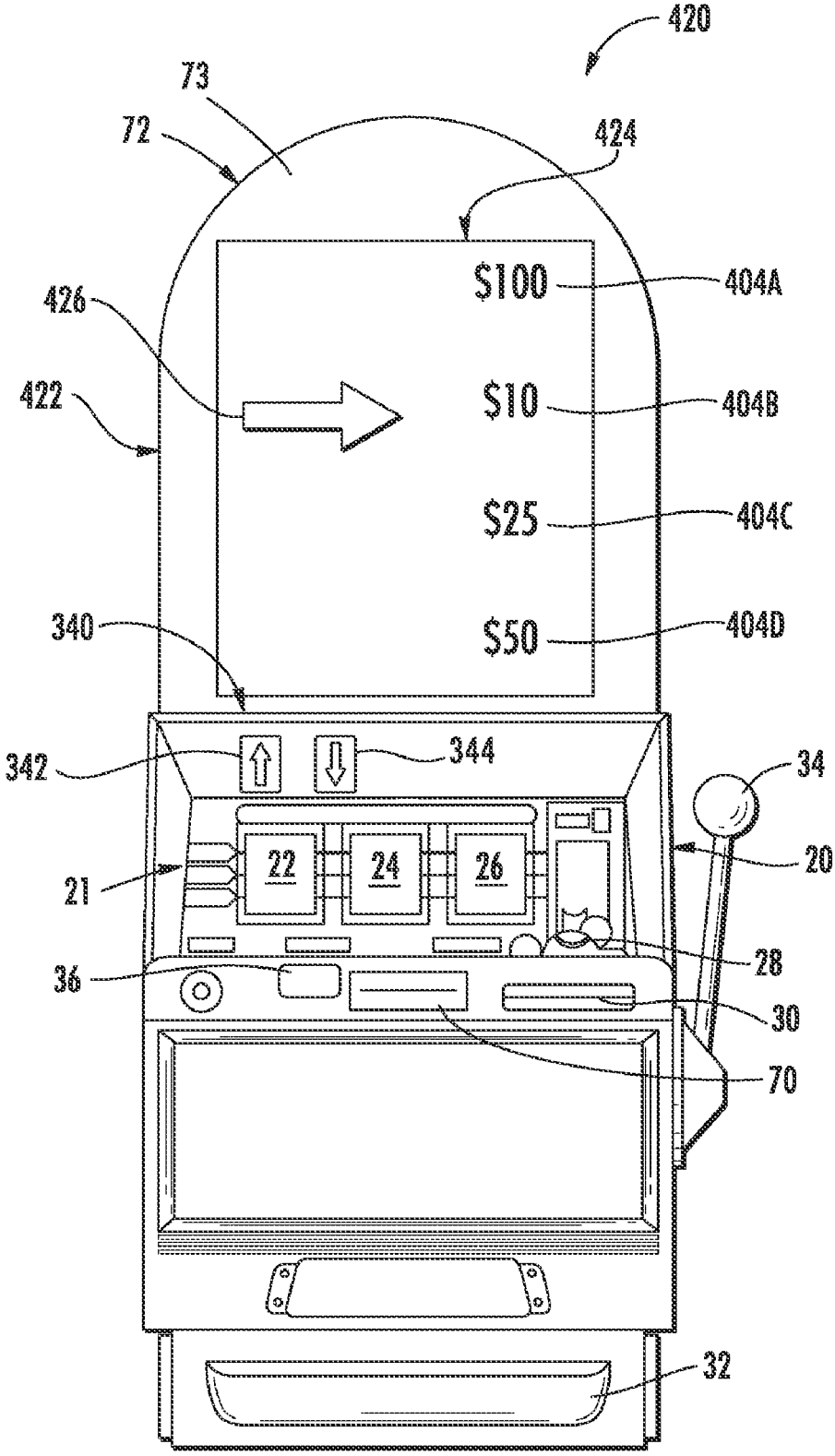
FIG. 15 is substantially a front view of another embodiment of a gaming device of the present invention.

With reference now to FIG. 15, another embodiment of the present invention is shown. Gaming device 420 has some similar and common features to gaming device 400 previously described in FIG. 14.

Gaming device 420 includes a primary game apparatus 20 that is identical to game apparatus 20 described in FIGS. 1 and 10. Gaming device 420 can also have a bonus game display 422. Bonus game display 422 is similar to bonus game display 401 of FIG. 14, except that moveable mechanical indicator 330 of FIG. 14 has been replaced with a video indicator 426 that is viewable on a larger video display 424. Video display 424 can be in communication with controller 40.

Video indicator 426 can move in any direction to indicate one of indicia 404A-404D as a prize. Video display 424 can be any type of video display that can show video presentations. Video display 424 can be liquid crystal (LCD), plasma, electro-luminescent or cathode ray tube (CRT) video display.

Gaming device 420 can operate similar to gaming device 400. The player may try to stop moveable video indicator 426 proximate or next to the prize indicia 404A-D showing the largest prize amount. After the player has selected a stop position for moveable video indicator 426, controller 40 may randomly determine a game outcome. The game outcome prize or indicia is then displayed on video display 424 closest to the stop position of the video indicator 330. Gaming device 420 can operate in the same manner as shown in method 380 of FIG. 13, except that the possible prizes or indicia are flashed on video display 424 instead of changeable prize displays 320A-D.

Fifth Alternative Embodiment

Figure 16:
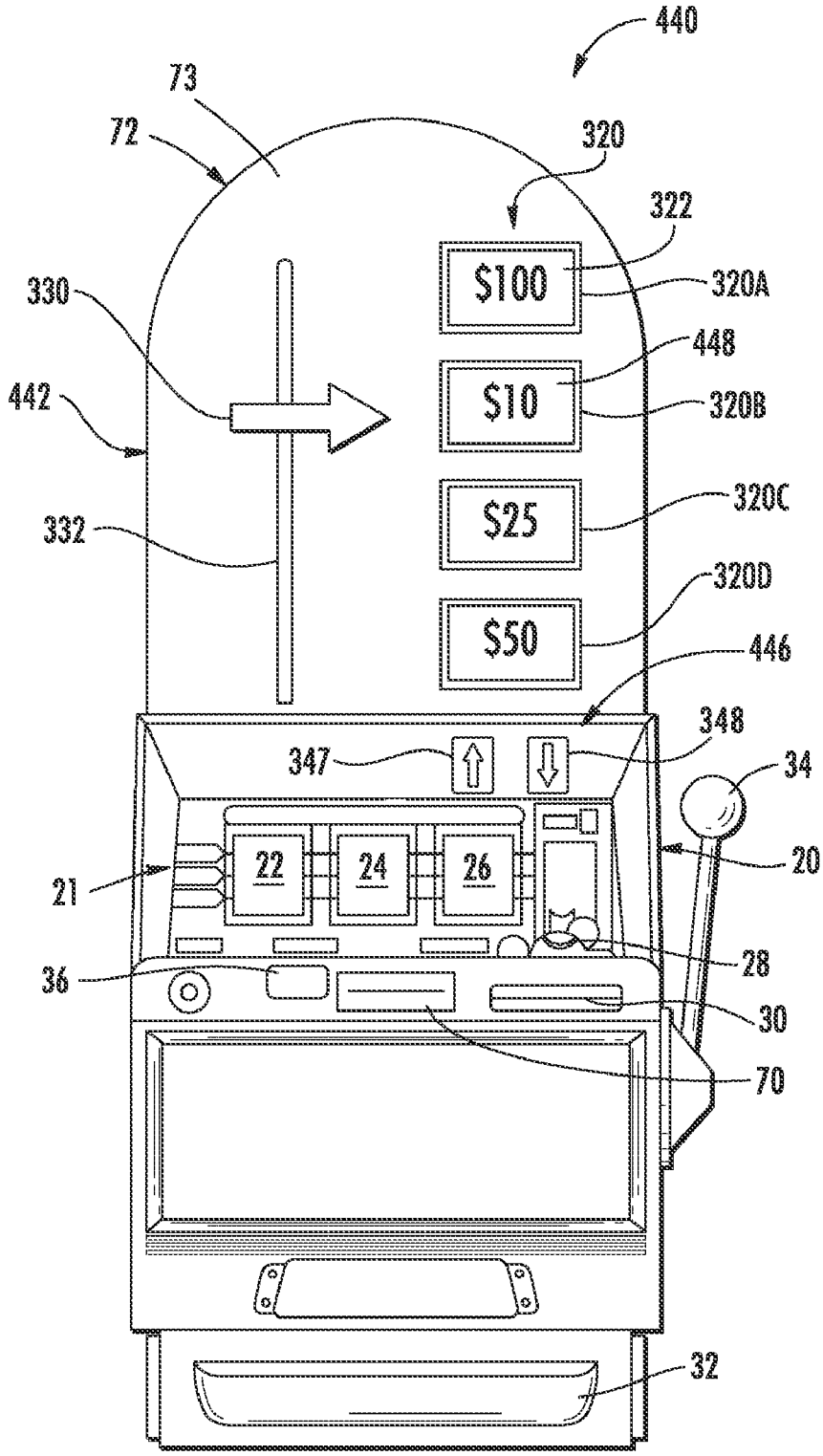
FIG. 16 is substantially a front view of an additional embodiment of a gaming device of the present invention.

With reference now to FIG. 16, an additional embodiment of the present invention is shown. Gaming device 440 has some similar and common features to gaming device 300 previously described in FIG. 10. Gaming device 440 includes a primary game apparatus 20 that is identical to game apparatus 20 described in FIGS. 1 and 10. Gaming device 440 can also have a bonus game display 442. Bonus game display is similar to bonus game display 310 of FIG. 10, except that a player input device or selector 446 allows a game player to select one of the changeable prize displays 320A-D on which a prize is shown.

Player input device 446 can be a variety of devices. In one embodiment, player input device 446 includes buttons 347 and 348 that allow the player to select the corresponding prize display. For example, the player would press the up button 347 to select a changeable prize display that is above the currently selected display. Down button 348 would be used to select a changeable prize display that is below the currently selected display. The selected display may be indicated by a brighter illumination of the display or flashing of the display. Alternatively, additional lights around each changeable prize display 320A-D may indicate the currently selected display. A touch screen (not shown) may also be provided in place of or in addition to buttons 347 and 348 in order to select one of the changeable prize displays 320A-D. In an alternative embodiment, the player may not be allowed to make a selection using selector 446 and controller 40 may automatically make all selections.

Once the player has selected one of the changeable prize displays 320A-D, controller 40 (FIG. 2) may direct positioning mechanism 50 (FIG. 2) to move moveable mechanical indicator 330 to stop adjacent one of the changeable prize displays 320A-D that was selected by the player using selector 446. A variety of indicia are rapidly displayed in sequence on changeable prize displays 320A-D.

The changeable prize display then can show a prize indicia or game outcome 448 on the selected changeable prize display. A video presentation may also be presented on one or more of the changeable prize displays. For example, as shown in FIG. 16, the player has selected changeable prize display 320B using player input device 446. Controller 40 has directed moveable mechanical indicator 330 to stop adjacent to changeable prize display 320B. Controller 40 has further determined a game outcome or prize and has directed the prize indicia 448 to be shown on changeable prize display 320B. FIG. 16 shows the combination of moveable mechanical indicator 330 and changeable prize display 320B indicating to a game player a bonus prize or game outcome.

While a variety of indicia may be shown on changeable prize displays 320A-D before the player selects one of the changeable prize displays 320A-D, controller 40 determines the final prize indicia 448 shown on the selected prize display. The selected prize display is changed rapidly to the game outcome 448 after the player has made a selection. In this manner, it may appear to the player that they have been able to influence the game outcome by which one of the changeable prize displays 320A-D they selected. However, any influence the player may feel is illusionary as controller 40 always determines the final game outcome.

Game Method of the Fifth Alternative Embodiment

Figure 17:
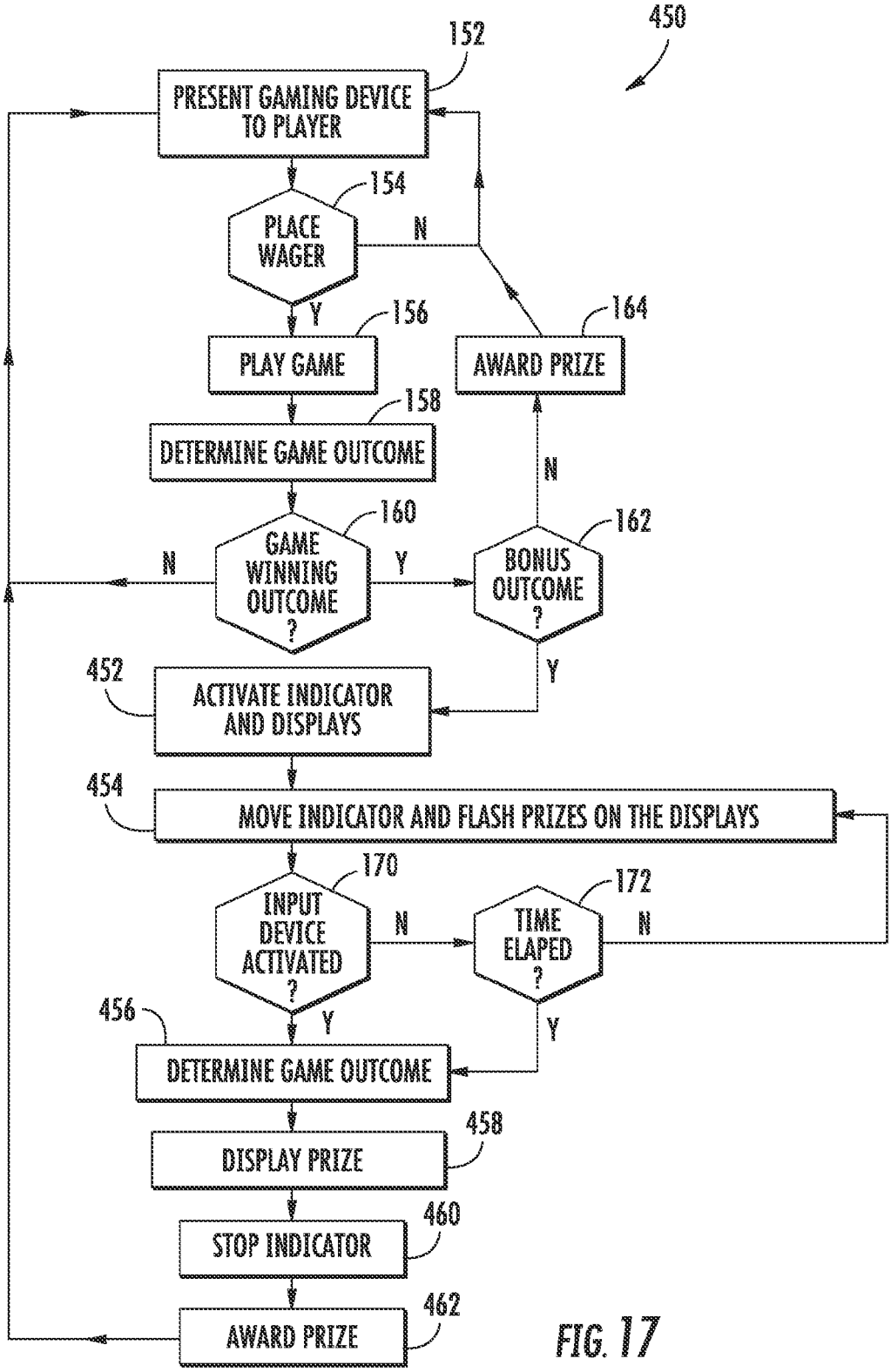
FIG. 17 is substantially a flow chart of a method of operation of the gaming device of FIG. 16.

Turning now to FIG. 17, a flowchart illustrating one possible method of operation of the gaming device 440 depicted in FIG. 16 is shown. The method, generally referred to as 450, begins by presenting a gaming device to a player at step 152. Decision 154 then determines if the player has placed a wager. If no wager has been placed, method 450 returns to step 152 until a wager is placed.

If a wager has been placed at decision 154, the player may activate the gaming device and play a game at step 156. The game outcome is determined at step 158. Decision 160 checks to see if the game outcome is a winning outcome.

If decision 160 determines that step 158 resulted in a losing outcome, method 450 returns to step 152. If decision 160 determines that step 158 resulted in a game winning outcome, method 450 proceeds to decision 162. Decision 162 determines whether the game outcome is a bonus activating outcome. If the game outcome from step 158 is not a bonus activating outcome, method 450 awards any prizes to which the player is entitled at step 164 and then returns to step 152.

If decision 162 determines that game outcome 158 is a bonus activating outcome, method 450 activates the bonus display at step 452, preferably enabling player input devices 347, 348, changeable prize displays 320A-D and moveable mechanical indicator 330. At step 454, mechanical indicator 330 is moved and prize indicia are sequentially displayed in a rapid manner on changeable prize displays 320A-D. A video presentation may also be shown on changeable prize displays 320A-D.

Next, method 450 proceeds to decision 170, which ascertains whether the player has activated player input devices 347 or 348 to select one of changeable prize displays 320A-D. If the player has not activated one of player input devices 347 or 348, method 450 may proceed to step 172. At step 172, method 450 checks to see if any preset time period has elapsed. For example, the game developer may limit the time period to thirty seconds. Once the time period elapses, one of the changeable prize displays 320A-D will be selected. If this time period has not elapsed, method 450 returns to step 168 and continues to move mechanical indicator 330 and to flash changeable prize displays 320A-D.

If the player has activated one of player input devices 347 or 348 at decision 170, or the time limit has expired in decision 172, method 450 proceeds to step 456. At step 456, the game outcome is determined by controller 40. The prize the player has won is displayed as indicia on the changeable prize display 320 selected by the player at step 458. Next, moveable mechanical indicator 330 is stopped at step 460. The player is then awarded any prizes at step 462 and then method 450 returns to step 152.

Many other methods may be used to operate the present invention. For example, the order of the steps in FIG. 17 may be altered or interchanged.

Conclusion

Although the description above contains many specifications, these should not be construed as limiting the scope of the invention but as merely providing illustrations of some embodiments of this invention. Thus, the scope of the invention should be determined by the appended claims and their legal equivalents rather than by the examples given.

What is claimed is:

1. A gaming device, the gaming device comprising:

(A) a plurality of changeable prize displays, each changeable prize display being configured to sequentially display a plurality of different prizes;

(B) at least one moveable indicator, the indicator being adapted to move relative to the changeable prize displays and to selectively indicate at least one of the prize displays by moving proximate the position of the indicated prize display;

(C) at least one player input device;

(D) at least one controller in communication with the player input device and the plurality of changeable prize displays, the controller being configured to:

(a) cause each of the changeable prize displays to sequentially display the plurality of different prizes;

(b) cause the moveable indicator to move relative to the changeable prize displays;

(c) randomly select a prize;

(d) detect activation of the player input device;

(e) cause the moveable indicator to stop, after the player input device is activated;

(f) cause a changeable prize display closest to the moveable indicator to display the randomly selected prize.

2. The gaming device of claim 1, wherein the moveable indicator further comprises an actuator in communication with the controller, the controller configured to direct the actuator to move the indicator.

3. The gaming device of claim 1, wherein the prizes are flashed in rapid sequence on the prize displays.

4. The gaming device of claim 1, wherein it appears that the selected prize was at least partially influenced by the player activating the player input device.

5. The gaming device of claim 1, wherein the prize displays are adapted to present a video presentation.

6. The gaming device of claim 5, wherein the controller is in communication with a server having game information, the controller being configured to receive the game information from the server and present a selected video presentation based on the game information.

7. The gaming device of claim 1, wherein a player input device is in communication with the controller, the player input device allowing the player to select one of the prize displays.

8. The gaming device of claim 7, wherein it appears that the selected prize was at least partially influenced by the player activating the player input device.

9. A gaming device, the gaming device comprising:

(A) a plurality of changeable prize displays, each changeable prize display being configured to sequentially display a plurality of different prizes;

(B) at least one moveable indicator, the indicator being adapted to move relative to the changeable prize displays and to selectively indicate at least one of the prize displays by moving proximate the position of the indicated prize display;

(C) at least one player input device;

(D) at least one controller in communication with the player input device and the plurality of changeable prize displays, the controller being configured to:

(a) cause each of the changeable prize displays to sequentially display the plurality of different prizes;

(b) cause the moveable indicator to move relative to the changeable prize displays;

(c) randomly select a prize;

(d) allow a player to select a prize display;

(e) cause the selected prize display to display the randomly selected prize;

(f) cause the moveable indicator to move proximate the selected prize display.

10. The gaming device of claim 9, wherein the moveable indicator further comprises an actuator in communication with the controller, the controller configured to direct the actuator to move the indicator.

11. The gaming device of claim 9, wherein the prize displays are adapted to present a video presentation.

12. The gaming device of claim 11, wherein the controller is in communication with a server having game information, the controller being configured to receive the game information from the server and present a selected video presentation based on the game information.

13. The gaming device of claim 9, wherein the moveable indicator and selected prize display in combination indicate a game outcome.

14. A gaming device comprising:

(A) video display means for displaying a plurality of video presentations;

(B) indicator means for indicating a prize;

(C) positioning means for moving the indicator means, the positioning means being adapted to move the indicator means relative to the video display means and to selectively indicate a prize;

(D) player input means for allowing a player to make a selection; and (E) a controller for controlling operation of the gaming device, the controller in communication with the video display means, the positioning means and the player input means, the controller being configured to:

(a) display a video presentation, the video presentation sequentially displaying a plurality of different prizes;

(b) move the indicator means relative to the video display means;

(c) randomly select a prize;

(d) detect a player selection;

(e) stop the indicator means; and (f) display the randomly selected prize proximate the indicator means.

15. The gaming device of claim 14, further comprising memory means for storing the video presentations.

16. The gaming device of claim 14, further comprising server means for storing game information, the controller being in communication with the server means, wherein the controller receives the game information from the server means and selects a video presentation based on the game information.

17. The gaming device of claim 14, wherein it appears that the selected prize was at least partially influenced by the player selection.

18. A method of playing a game comprising, but not necessarily in the order shown:

(A) sequentially displaying a plurality of different prizes on a plurality of changeable prize displays;

(B) moving a moveable indicator proximate to the changeable prize displays;

(C) providing a player input device;

(D) allowing a player to stop the moveable indicator using the player input device;

(E) randomly selecting a prize; and (F) displaying the selected prize on the prize display closest to the stopped moveable indicator.

19. The method of claim 18, further comprising presenting a video presentation on the prize displays.

20. The method of claim 18, further comprising receiving game information from a server and presenting the video presentation based on the game information.

* * * * *